US009644337B1

(12) United States Patent
Stiles et al.

(10) Patent No.: US 9,644,337 B1
(45) Date of Patent: May 9, 2017

(54) SYSTEMS AND METHODS FOR POSITIONING AND ANCHORING COLUMNS

(71) Applicants: Richard Stiles, Pompano Beach, FL (US); David Stiles, Pompano Beach, FL (US)

(72) Inventors: Richard Stiles, Pompano Beach, FL (US); David Stiles, Pompano Beach, FL (US)

(73) Assignee: Precast Wall Systems, Inc., Pompano Beach, FL (US)

( * ) Notice: Subject to any disclaimer, the term of this patent is extended or adjusted under 35 U.S.C. 154(b) by 0 days.

(21) Appl. No.: 15/247,295

(22) Filed: Aug. 25, 2016

(51) Int. Cl.

| | |
|---|---|
| ***E02D 13/02*** | (2006.01) |
| ***E02D 27/42*** | (2006.01) |
| ***E02D 13/04*** | (2006.01) |
| ***E02D 27/14*** | (2006.01) |
| ***E02D 27/16*** | (2006.01) |
| ***E02D 7/02*** | (2006.01) |
| ***E02D 7/30*** | (2006.01) |
| ***E02D 5/18*** | (2006.01) |
| ***E02D 5/38*** | (2006.01) |
| ***E02D 27/50*** | (2006.01) |
| ***E04C 3/30*** | (2006.01) |
| ***E02D 5/74*** | (2006.01) |

(52) U.S. Cl.
CPC ..... *E02D 27/42* (2013.01); *E02D 5/182* (2013.01); *E02D 5/385* (2013.01); *E02D 5/74* (2013.01); *E02D 7/02* (2013.01); *E02D 7/30* (2013.01); *E02D 13/04* (2013.01); *E02D 27/14* (2013.01); *E02D 27/16* (2013.01); *E02D 27/50* (2013.01); *E04C 3/30* (2013.01)

(58) Field of Classification Search
CPC . E02D 13/04; E02D 7/02; E21B 41/08; E21B 43/017; E04H 12/22
See application file for complete search history.

(56) References Cited

U.S. PATENT DOCUMENTS 3,832,858 A * 9/1974 Anders ..... E02D 7/26 173/24
4,317,488 A * 3/1982 Shotbolt ..... E21B 33/035 166/351
4,687,062 A * 8/1987 Beghetto ..... E21B 41/08 166/366

(Continued)

*Primary Examiner* — Rodney Mintz
*Assistant Examiner* — Daniel Kenny

(57) ABSTRACT

A system for positioning and anchoring columns. The system includes a positioning template having a first frame configured to support horizontal panels, jacking mechanisms for leveling the horizontal panels, a first opening defined by the horizontally aligned panels configured to guide a sleeve when driven downward below grade level through the first opening, and a tubular sleeve for passing through the first opening and for receiving a second frame. The second frame includes frame members defining a second opening on each end of the second frame and a plurality of elongated bars spanning between the first end and the second end. The second frame is for guiding a pile when driven downward. A pile having a first end and an opposing second end is configured for receiving a connecting tube of a column. A column having a connecting tube is to inserted into the pile's first end.

19 Claims, 18 Drawing Sheets

(56) References Cited

U.S. PATENT DOCUMENTS

| | | | | |
|---|---|---|---|---|
| 4,907,915 | A * | 3/1990 | Nicholson | E02D 7/16 405/229 |
| 9,328,477 | B2 * | 5/2016 | Goodbourn | E02D 13/04 |
| 9,394,665 | B2 * | 7/2016 | Wellens | E04H 12/2284 |

* cited by examiner

SYSTEMS AND METHODS FOR POSITIONING AND ANCHORING COLUMNS

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The present invention relates to the field columns, and more specifically to the field of positioning and anchoring columns.

BACKGROUND

Precast concrete is a construction product produced by casting concrete in a reusable mold or "form". The concrete in a flowable state is then cured in a controlled environment, transported to the construction site and lifted into place. In contrast, standard concrete in a flowable state is poured into site-specific forms and cured on site.

Precast concrete building components and site amenities are used architecturally as fireplace mantels, cladding, trim products, accessories and curtain walls. Structural applications of precast concrete include foundations, beams, floors, fences, walls and other structural components.

Precast fence walls or walls usually refers to concrete walls simply precast concrete columns, spaced four to twenty feet apart with wire, paneling or concrete panels strung between each column. In many cases the installation of the concrete columns requires the use of piles below the concrete column. A pile is a type of foundation which transfers loads to the earth farther down from the surface than a shallow foundation does, to a subsurface layer or a range of depths.

One problem faced with the installation of piles below concrete or other pre-cast columns is the accurate placement and anchoring of the columns. In many cases, each pile must be driven many feet below grade. In certain systems, this may require excavating the area of the intended pile location. As a result of such excavation, in areas having a relatively a high water table, water may flow into the excavated area making it very difficult to install the pile.

Another problem associated with accurate locating and positioning of concrete columns and piles is low overhead clearance above the intended pile hole and column position. Currently, with the use of the existing prior art, the installation of piles and concrete columns require material and equipment that require a relatively large amount of vertical clearance. However, in certain areas, such as areas below high voltage wires and fixed overhanging structures, not enough overhead space may be available to maneuver the equipment and materials to properly install the pile and column when using the existing prior art.

As a result, of the existing limitations and others, there exists a need for improvements over the prior art and more particularly for a more efficient way of positioning and anchoring columns.

SUMMARY

Systems and method for positioning and anchoring columns is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a system for positioning and anchoring columns is disclosed. The system includes (a) a positioning template comprising: a first frame configured to support a plurality of horizontally aligned panels; a plurality of jacking mechanisms, wherein the jacking mechanisms are configured for leveling the horizontally aligned panels; a first opening defined by the horizontally aligned panels, wherein the panels are configured to guide a sleeve when the sleeve is driven downward below grade level through the first opening; (b) a tubular sleeve, wherein the tubular sleeve is configured for passing through the first opening of the first frame and for receiving a second frame inside the tubular sleeve; (c) a second frame comprising: a first end and an opposing second end, wherein each end of the second frame includes a plurality of frame members that define a second opening; a plurality of elongated bars spanning between the first end and the second end, wherein the second frame is configured to guide a pile when the pile is driven downward below grade level; (d) a pile, the pile having a first end and an opposing second end; (e) a column, wherein the column has a first end and an opposing second end, wherein a connecting tube extends out from the second end.

Additionally, in one embodiment a method for positioning and anchoring columns is disclosed. The method includes: (a) positioning a template above an intended hole location, wherein the template comprises: a first frame configured to support a plurality of horizontally aligned panels; a plurality of jacking mechanisms, wherein the jacking mechanisms are configured for leveling the horizontally aligned panels; a first opening defined by the horizontally aligned panels, wherein the panels are configured to guide a sleeve when the sleeve is driven downward below grade level through the first opening; (b) leveling the horizontally aligned panels using the jacking mechanisms; (c) removing material from the intended hole location to form a hole; (d) inserting a tubular sleeve below grade level by passing the tubular sleeve through the first opening; (e) inserting a second frame into the tubular sleeve, wherein the second frame comprises: a first end and an opposing second end, wherein each end of the second frame includes a plurality of frame members that define a square shaped opening; an elongated bar spanning between the first end and the second end along each frame member, wherein the second frame is configured to guide a pile when the pile is driven downward below grade level; (f) inserting a pile into the square shaped opening and forcing the pile downward until a first end of the pile is proximate to grade level; (g) removing the second frame; (h) forcing the pile down until a second end of the pile reaches a desired depth; (i) positioning a connecting tube of a column into the first end of the pile; and, (j) filing the pile and hole with concrete in a flowable state. Additionally, the method may also include between steps (h) and (i), installing a reinforcing matrix around the pile, the reinforcing matrix comprising a plurality of vertically aligned rods coupled to a plurality of horizontally aligned loops, and, between steps (i) and (j), moving the tubular sleeve to above the panels.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 2:
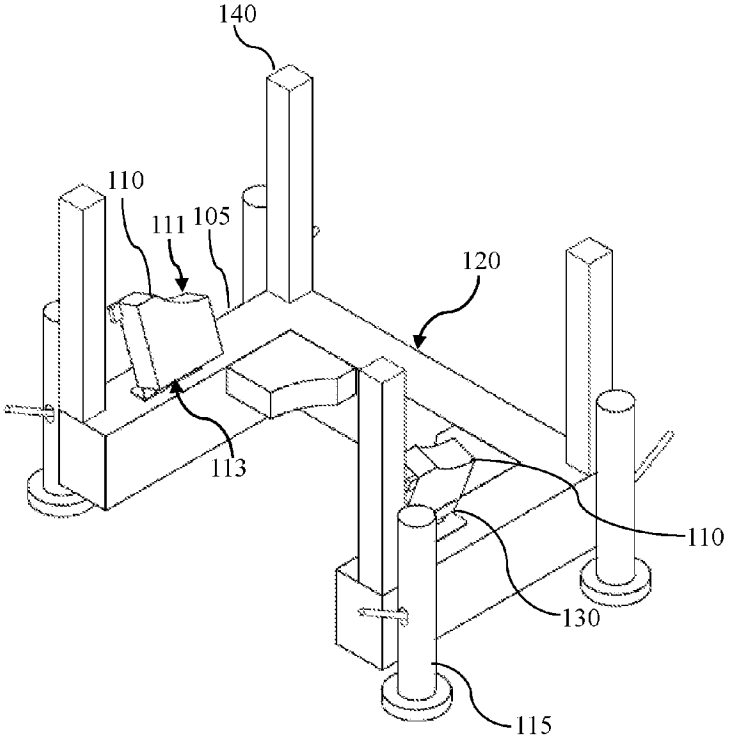
FIG. 2 is a perspective view of the positioning template with two of its panels in an open configuration, according to a non-limiting example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a system for accurately positioning and anchoring columns. The system includes at least a positioning template and a second frame for accurate positioning of columns. A tubular sleeve, which may be removed and re-used, is included to guide a second frame when driven downward. The second frame defines second openings that allow to accurately guide the pile when driven downward below grade level. The system also provides a means for positioning and anchoring columns and piles even with high water tables and low overhead clearances. The system includes a pile that is adapted for forming a mechanical connection via a connecting tube located on one end of a column.

Referring now to the Figures, FIGS. 1-6 are illustrations of the positioning template or template 101 according to one non-limiting embodiment. The positioning template is positioned above an intended hole location. The positioning template must be accurately positioned above the intended hole location of where a pre-cast column is to be installed. In operation, a user may use locating devices used for land surveying, such as Global Positioning Systems, to ensure that positioning template is positioned correctly.

The positioning template includes a u-shaped frame or first frame 105 configured to support a plurality of horizontally aligned panels 101. The u-shaped frame may comprise material such as steel, iron, wood, or other materials suitable for carrying heaving loads or absorbing significant forces. In the present embodiment, the first frame is u-shaped however it is understood that other shapes may be used that accomplish the desired function.

In the present embodiment, the system comprises four panels that are attached to the u-shaped frame that form an opening 125. Two of the panels are pivotally connected by a hinging mechanism to the u-shape frame so that a first end 111 of the panels can move away from the center point 126 of the first opening. The first opening 125 is defined by the shape of the horizontally aligned panels. The u-shaped frame and first opening are configured to guide a sleeve when the sleeve is driven downward below grade level through the first opening. The curved features at the first ends of the panels define a shape that restricts the movement of a sleeve (further explained below) when the sleeve is positioned within the first opening. The panel may comprise load bearing material such as steel, iron, wood, or other materials suitable for carrying heaving loads or absorbing significant forces.

The panels that are pivotally or movably connected to the frame by a hinge such as a piano hinge, butt hinge, t-hinge, gate hinge, double-acting hinge, soss hinge, special purpose hinge, pivot hinge, etc. The pivoting function of the hinge allows the first end 111 of the panels to move away from the center or center point 126 of the first opening as illustrated in FIG. 2. FIG. 2 is a perspective view of the positioning template with two of its panels in an open configuration. In the open configuration, a tubular sleeve 700 or sleeve may be more easily maneuvered and positioned into the first opening defined by the panels than when the panels are in the closed configuration as illustrated in FIGS. 1, and 3-6.

A jacking mechanism 115, such as a level jack are spaced apart from each other proximate to a perimeter 120 of the u-shaped frame and configured for leveling the horizontally aligned panels. The jacking mechanisms are used to level the horizontally aligned panels. The leveling of the horizontally aligned panels is important so that when the tubular sleeve or sleeve 700 is driven downward into the ground, the tubular sleeve moves downward in a vertical position. For example, if the panels are not leveled along the x-y plane, then the tubular sleeve will be driven downward below ground level at an angle. The leveling jack may be a pneumatic, electric, or hydraulic jack etc. In operation, a consumer may user a sensor to level the horizontal panels along the x-y plane. In operation of the system, all four jacks are extended so as to be in contact with the ground to initially stabilize the system. In operation, the system may use a digital level sensor and processor (for example, a tilt sensor having a digital output) to calculate plane of the panels, and then jack(s) need to be extended accordingly in order to level the panels along the x-y plane.

The frame may also include posts 140 spaced along the perimeter 120 of the u-shaped frame. Each post is configured for anchoring a line coupled to a column when said column is positioned inside first opening (see FIGS. 35-40 and further explained below). Each post may be rectangular, however, other shapes may also be used, such as triangular or cylindrical, may also be used and are within the spirit and scope of the present invention. Each post may comprise material such as concrete, wood, metal, iron, wrought iron, cast iron, steel, stainless steel, composites, alloys, bamboo, reinforce plastic or other materials capable for resisting loads.

Figure 9:
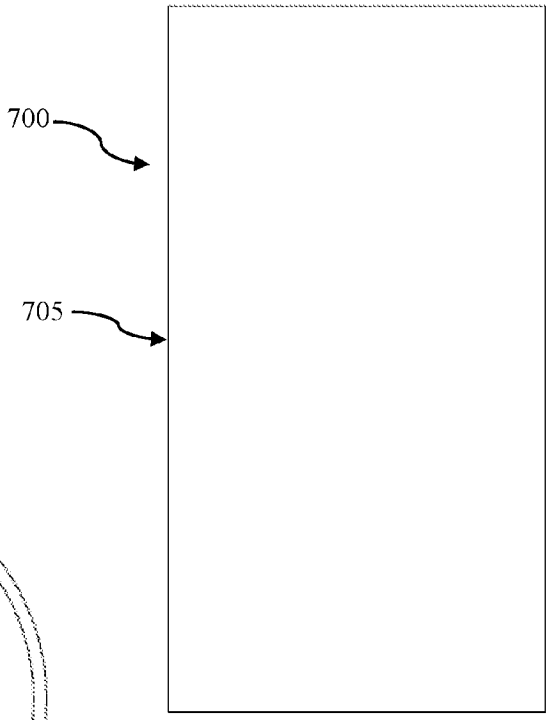
FIG. 9 is a side view of the tubular sleeve of the system, according to a non-limiting example embodiment.
Figure 8:
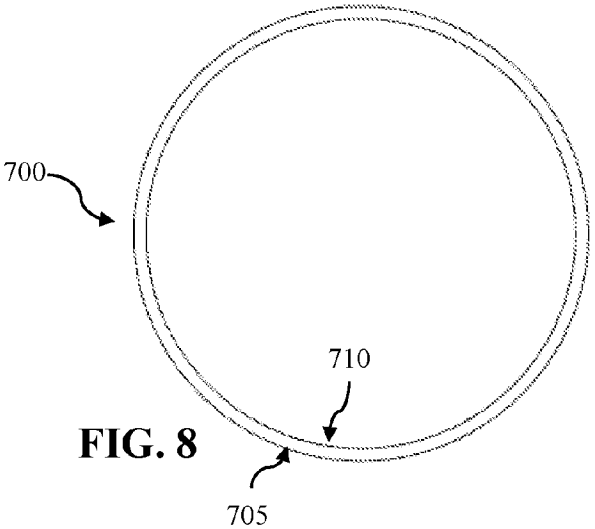
FIG. 8 is a top view of the tubular sleeve of the system, according to a non-limiting example embodiment.
Figure 7:
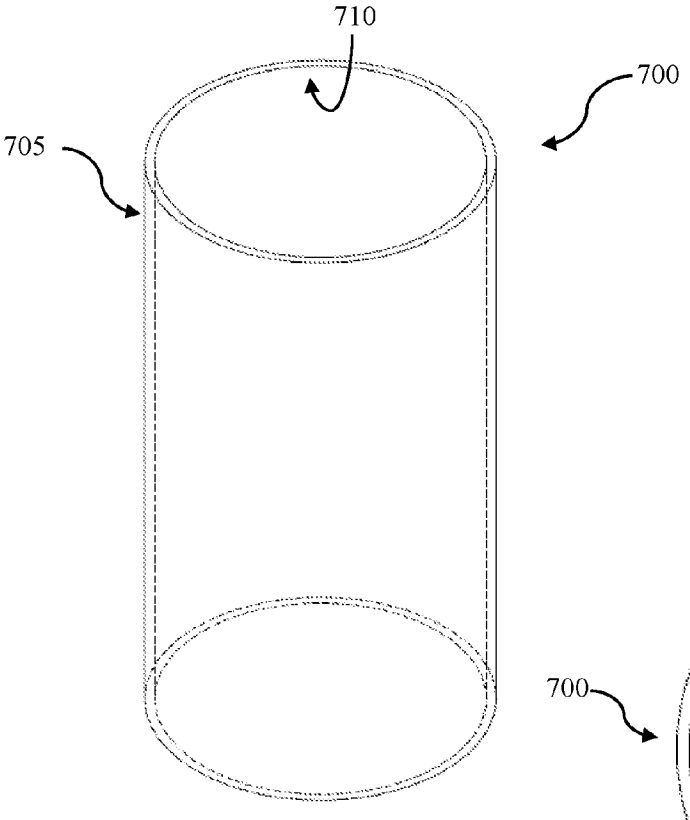
FIG. 7 is a perspective view of a tubular sleeve of the system, according to a non-limiting example embodiment.

The system for positioning and anchoring columns also includes a tubular sleeve 700. FIGS. 7-9 are views of the tubular sleeve. The tubular sleeve is configured for passing through the first opening of the first frame and for receiving a second frame 1000 inside the tubular sleeve. The tubular sleeve is configured such that when the tubular sleeve is positioned inside the first opening when the panels are in the closed configuration, a very small space exists between the outside wall 705 of the tubular sleeve. In one embodiment, the tubular sleeve has an outer cross-sectional diameter of approximately 36". The tubular sleeve may comprise material capable of withstanding loads such as metal, iron, wrought iron, cast iron, steel, stainless steel, composites, alloys, reinforce plastic or other materials capable for resisting loads. The inside cross-sectional diameter of the tubular sleeve is such that the inside wall 710 of the sleeve does surrounds the second frame (as further explained below).

Figure 12:
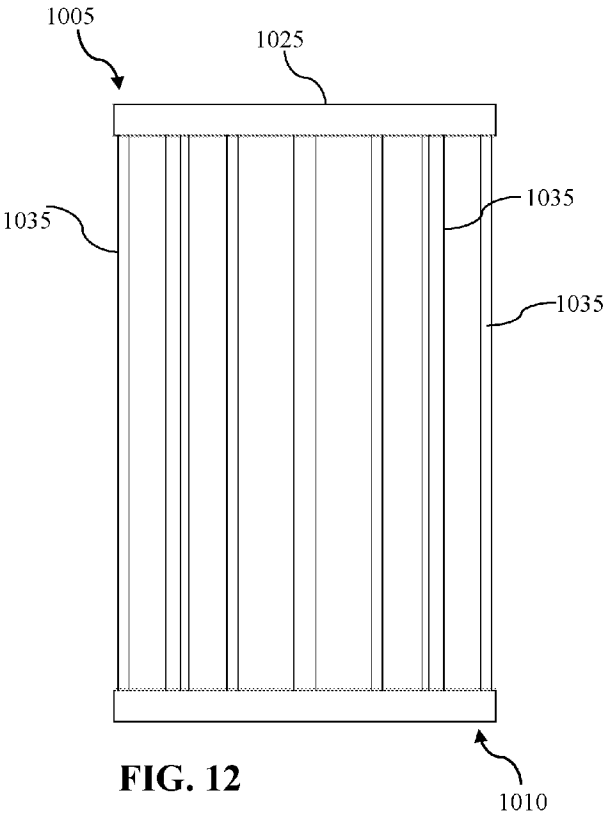
FIG. 12 is a side view of the second frame, according to a non-limiting example embodiment.
Figure 11:
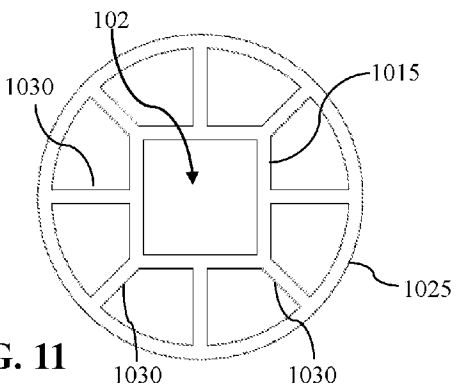
FIG. 11 is a top view of the second frame, according to a non-limiting example embodiment.
Figure 10:
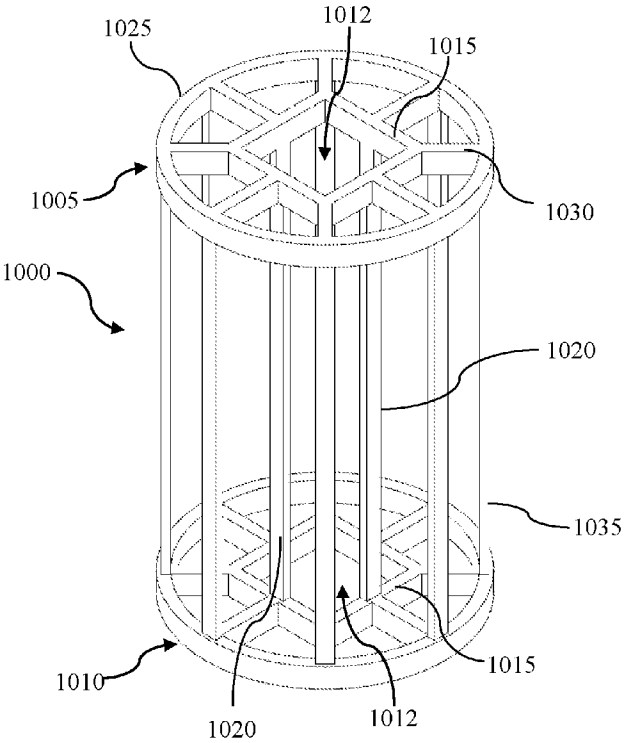
FIG. 10 is a perspective view of a second frame of the system, according to a non-limiting example embodiment.

The system also includes a second frame 1000. The second frame is illustrated in FIGS. 10-12. The second frame includes a first end 1005 and an opposing second end 1010. In the present embodiment, the second frame is cylindrical in nature and is configured for being received within the tubular sleeve 700. Each end of the second frame defines a second opening 1012 surrounded by frame members 1015. In the present embodiment the second opening defines a square shape, however, it is understood that in other embodiments, the square shaped opening or second opening may be a different shape to accommodate the shape of the cross-sectional perimeter of the pile (further explained below). For example, if the pile is circular shaped, then the second opening will be circular and a single circular frame member will define that circular opening.

Each frame member 1015 that surrounds the square shaped opening or second opening is connected by an auxiliary frame member 1030 that spans from the circular shaped frame member 1025 to frame members 1015 surrounding the circular shaped openings. In the present embodiment, an elongated bar 1020 spans between the first end and the second end along each of the frame members. The second frame is configured to guide a pile (illustrated in FIGS. 13-15) when the pile is driven downward below grade level through the second or square shaped openings and between the elongated bars. The frame members and the elongated bars restrict the pile from moving when inserted in the second frame. However, it is understood that, for example, if the second opening is another shape, such as circular, then the pile would be cylindrical, and the elongated bars may be positioned along the circumference of the second opening (which is circular) spanning from the first end of the second frame to the second end of the frame so that the second opening and the elongated bars may guide the pile as it is driven downward.

The second frame also includes a plurality of vertical outside supporting members 1035 spanning between the first end and second end along or proximate to the second frame. The outside supporting members provide additional support to the second frame. In operation, the second frame may be configured to be inserted inside of the tubular sleeve 700 such that the square shaped opening or second opening 1012 is centered inside of the tubular sleeve. In one non-limiting embodiment, the outside cross-sectional diameter of the second frame may be 35" inches+/−¼" such that a very small amount of space exists between the inside wall of the tubular sleeve 700 outside of the second frame. One of the functions of the second frame is such that the second frame guides a pile (illustrated as 1300 in FIGS. 13-15) when the file is driven downward below grade level such that the pile remains substantially vertical. Members 1015, 1020, 1030, 1035 of the second frame may comprise material capable of withstanding loads such as metal, iron, wrought iron, cast iron, steel, stainless steel, composites, alloys, reinforce plastic or other materials capable for resisting loads.

Figure 15:
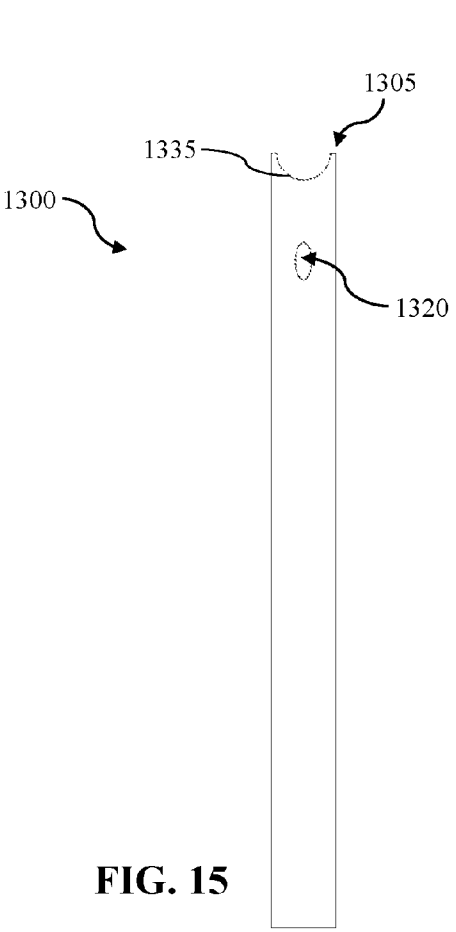
FIG. 15 is a side view of the pile, according to a non-limiting example embodiment.
Figure 14:
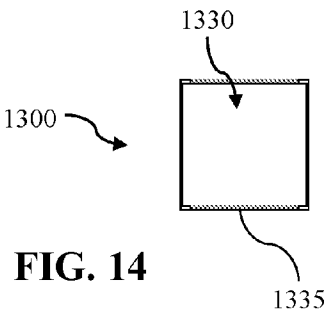
FIG. 14 is a top view of the pile, according to a non-limiting example embodiment.
Figure 13:
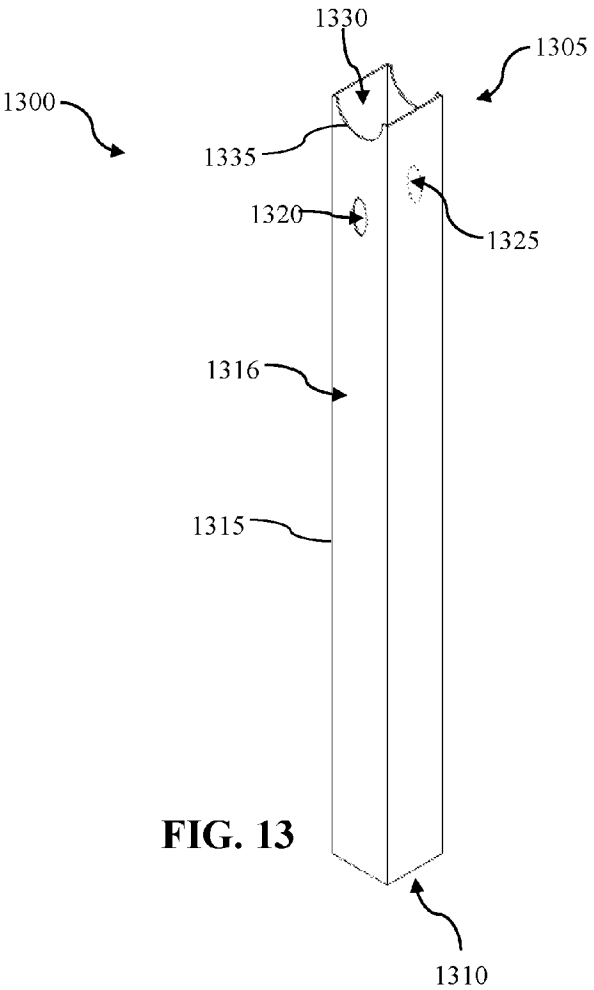
FIG. 13 is a perspective view of a pile of the system, according to a non-limiting example embodiment.
Figure 18:
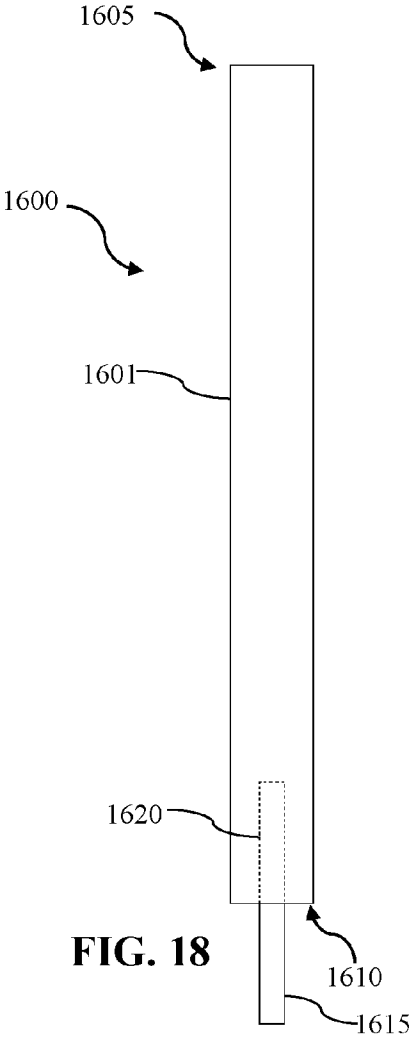
FIG. 18 is a side view of the column, according to a non-limiting example embodiment.
Figure 16:
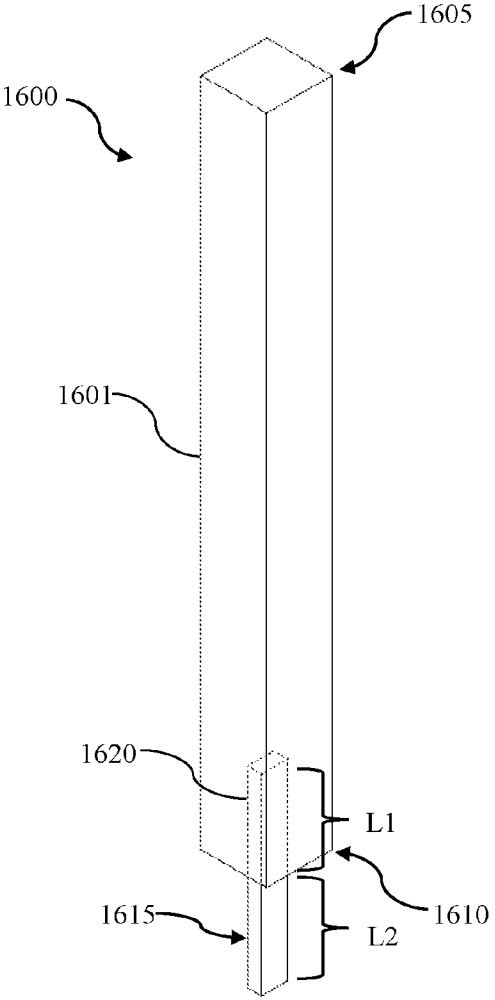
FIG. 16 is a perspective view of a column of the system, wherein the column has a connecting tube, according to a non-limiting example embodiment.

The system also includes a pile 1300 as illustrated in FIGS. 13-15. The pile has a first and 1305 opposing a second. The pile comprises a square tubular shaped body 1315 having a first end 1305 and an opposing second end 1310. As mentioned above, the cross-sectional square shape of the pile be the different shades that corresponds to the cross-sectional shape of the opening in the first and second ends of the second frame. In other words, the square shape of the pile is not meant to be a limitation and other shapes may be used. The pile is tubular shaped such that concrete in a flowable state may be pumped into the pile through an opening 1320 or a second opening 1325, which are positioned proximate to the first end of the pile. The first end of the pile has an edge 1335 that defines a concave shape. The first end of the pile is configured for receiving a connecting tube 1615 of the column (illustrated in FIGS. 16-18). The pile is configured to be received inside of the square shaped opening or second opening 1012 of the second frame. The frame members 1015 and the elongated bars 1020 of the second frame guide the square shaped body of the pile as it is driven downward when the system is being used. As the pile is being driven downward, the second frame guides and maintains the second pile in a substantially vertical position.

Figure 17:
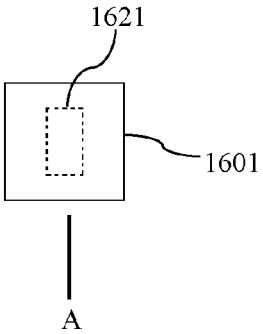
FIG. 17 is a top view of the column, according to a non-limiting example embodiment.
Figure 41:
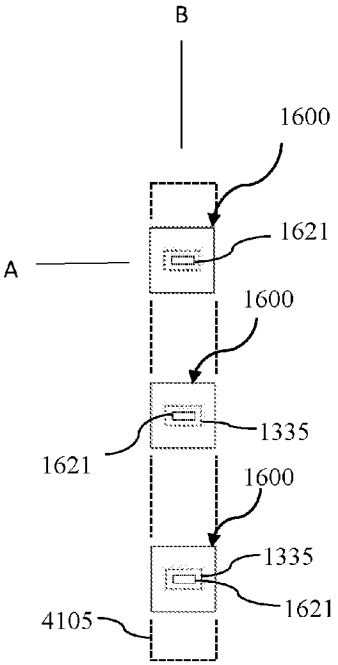

The system allows the pre-cast column 1600 to be accurately positioned. The pre-cast column includes an elongated body 1601 having a first end 1605 opposing a second end 1610. In the present embodiment, the precast column is square shaped, however other cross-sectional shapes may also be used. The precast column may also include a rectangular shaped tube 1615 that extends outward from the second end. The connecting tube of the column is configured for being received within the opening 1330 of the first end of the pile. In the present embodiment, the connecting tube is rectangular shaped having a rectangular perimeter 1621 and orientated such that longitudinal axis represented by line A (as illustrated in FIGS. 17 and 41) is perpendicular with the longitudinal axis of anticipated or proposed wall (such as the line B in FIG. 41). Such an orientation provides allows for a greater amount of support against forces that may be applied perpendicular to the longitudinal axis of anticipated wall. The length of the precast columns may be modular in design in order to be made into different heights. The precast column is configured such that the second end of the precast column sits on top of the pile. The concave first end of the pile provides an air vent to reduce pressures that may arise when concrete in a flowable state is pumped into either the first or second openings of the pile. When the second end of the column is positioned on top of the first end of the pile such that the connecting tube enters the opening 1330 of the pile, the concave end of the pile forms an opening or air flow vent 3507 (illustrated in FIG. 35) between the pile and the second or lower end of the column such that when concrete in a flowable state is pumped into either the first 1320 or second openings 1325 of the pile, the openings allow air and other substances to flow or move out of the opening 3507 as required. Additionally, the opening 3507 provided by the concave end allows concrete in the flowable state to completely fill the pile, which provides for a stronger connection between the pile and the column. The connecting tube 1615 may comprise material capable of supporting load such as metal, iron, wrought iron, cast iron, steel, stainless steel, composites, alloys, reinforce plastic or other materials capable for resisting loads. The connecting tube has a first part 1620 that extends into the body of the pre-cast column. The first part 1620 of the connecting tube has a length L1 that is substantially the same as the second part L2. In operation, when the connecting to is positioned inside of the first end of the pile, concrete in a flowable state can be filled or pumped into the pile into the surrounding area within the hole such that when the concrete in the flowable state cures, the connecting and pile are connected.

Figure 20:
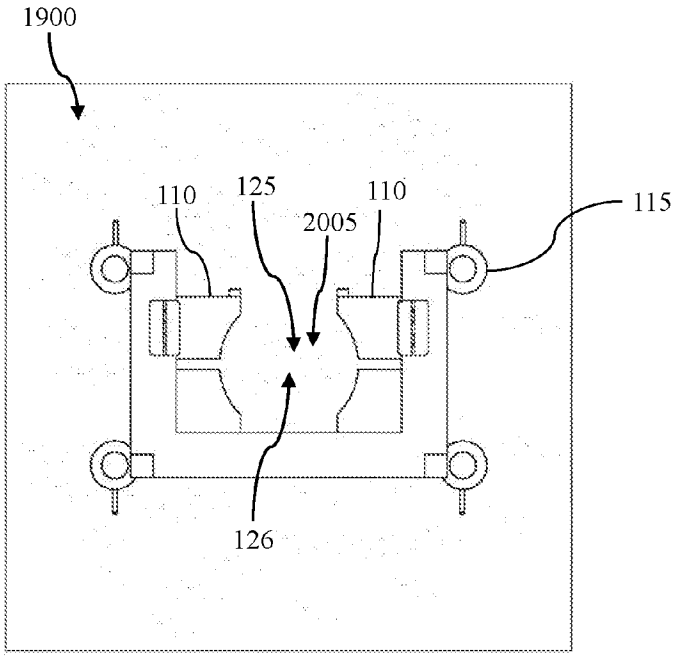
FIG. 20 is a top view of the positioning template located above an intended hole and column location, according to a non-limiting example embodiment.
Figure 19:
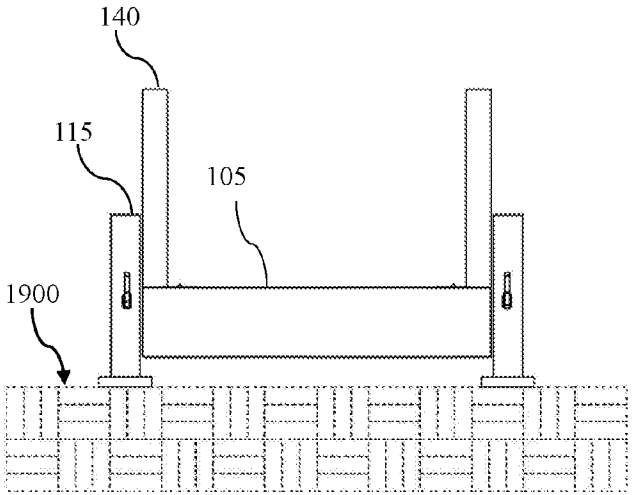
FIG. 19 is a rear partial cross-sectional view of the positioning template located above an intended hole and column location, according to a non-limiting example embodiment.

FIG. 19 illustrate the system and methods for positioning and anchoring columns. FIG. 19 is a rear view of the positioning template located above an intended hole and column location, according to a non-limiting example embodiment, and FIG. 20 is a top view of FIG. 19, according to a non-limiting example embodiment. FIGS. 19 and 20 illustrate the positioning template positioned above grade level 1900 of an intended hole location 2005 where the column is to be eventually installed.

In one embodiment, the positioning template may comprise: a u-shaped frame 101 configured to support a plurality of horizontally aligned panels 110; a plurality of jacking mechanisms 115, wherein the jacking mechanisms are spaced apart from each other proximate to a perimeter 120 of the u-shaped frame and configured for leveling the horizontally aligned panels; a first opening 125 defined by the horizontally aligned panels, wherein the u-shaped frame is configured to guide a sleeve when the sleeve is driven downward below grade level through the first opening. However, it is understood that the jacking mechanisms may be positioned at various locations and the illustrated locations not meant to be a limitation.

In operation, a user or worker obtains coordinates for where a column is to be installed and marks the intended location of the hole in the ground. Next, a user may position the first opening 125 of the positioning template 101 above such location. Additionally, other means of locating the correct hole location may also be used. A user may use a GPS, survey etc. in order to determine the position of the intended hole. After positioning the positioning template, over the intended hole location, a user may remove material from the intended hole location in order to form a hole so that the tubular sleeve maybe installed. Additionally, after positioning the positioning template above the intended hole location, a user may use the jacking mechanisms 115 to level the horizontally aligned panels so that the panels are level along the x-y plane. As mentioned before, the purpose of leveling the horizontal panels is such that when the tubular sleeve 700, second frame 1000 and pile 1300 are driven downward, the tubular sleeve, second frame and pile remain substantially vertical. This allows the pile to be driven vertically downward so that when the column is connected on top of pile the pile will be vertical.

Figure 1:
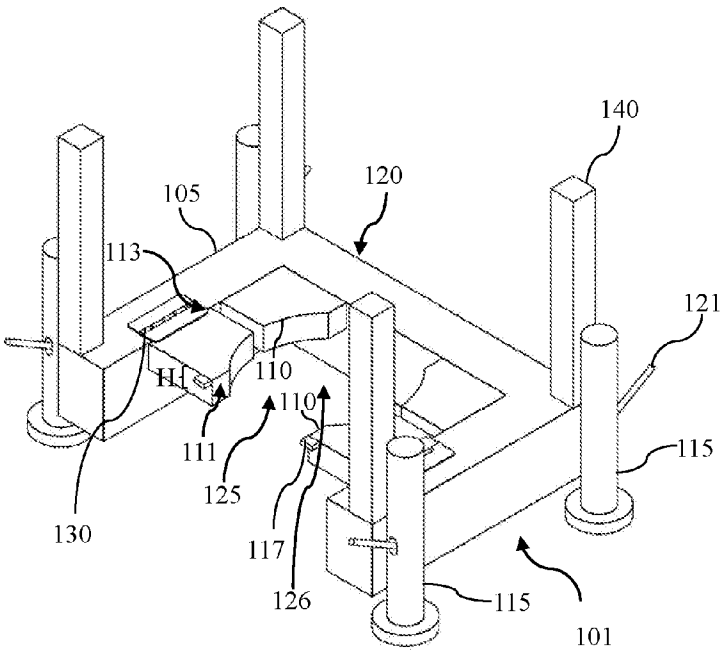
FIG. 1 is a perspective view of a positioning template of the system in a closed configuration, according to a non-limiting example embodiment.
Figure 4:
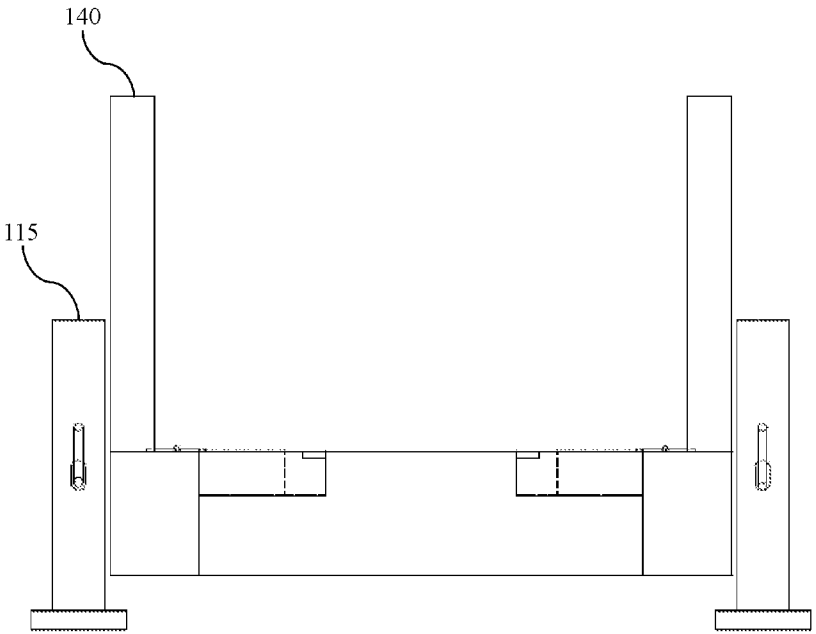
FIG. 4 is a front view of the positioning template in the closed configuration, according to a non-limiting example embodiment.
Figure 3:
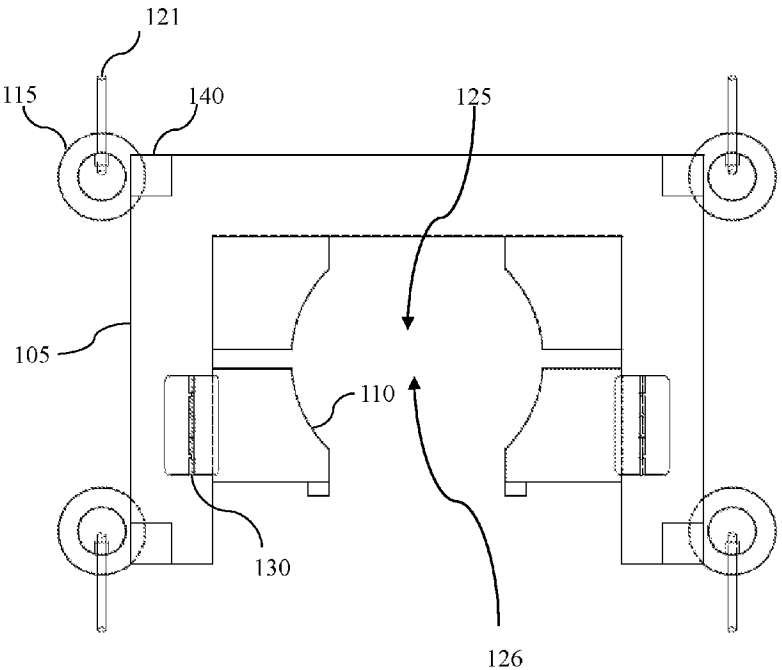
FIG. 3 is a top view of the positioning template in the closed configuration, according to a non-limiting example embodiment.
Figure 6:
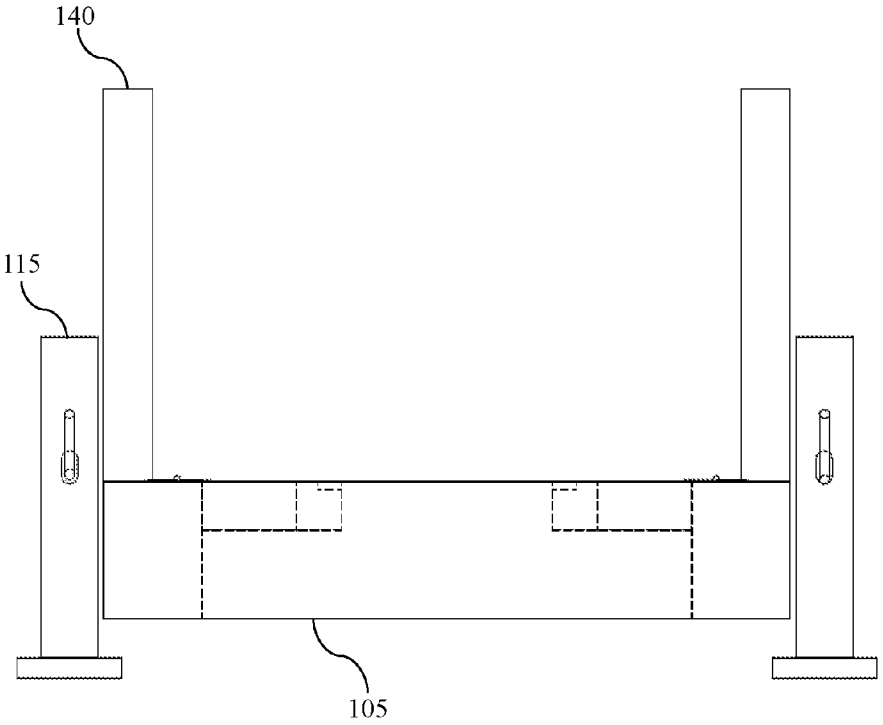
FIG. 6 is a rear view of the positioning template in the closed configuration, according to a non-limiting example embodiment.
Figure 5:
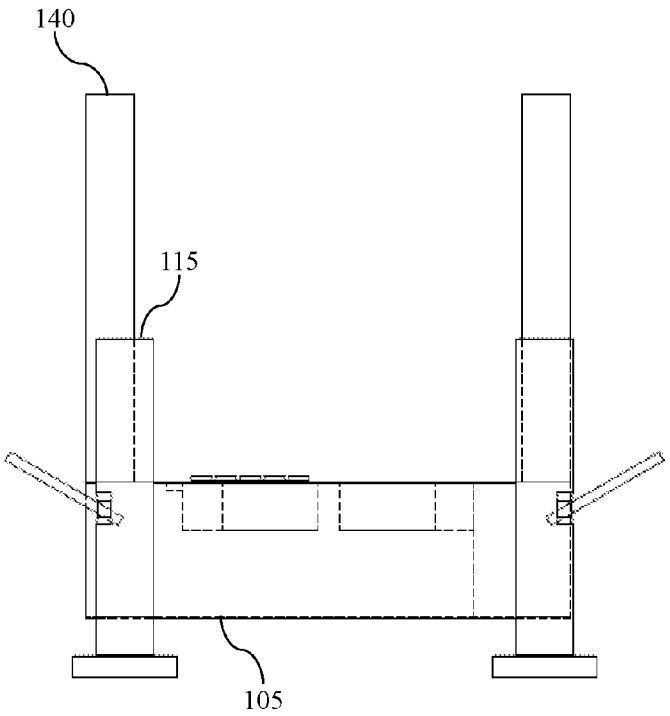
FIG. 5 is a side view of the positioning template in the closed configuration, according to a non-limiting example embodiment.
Figure 22:
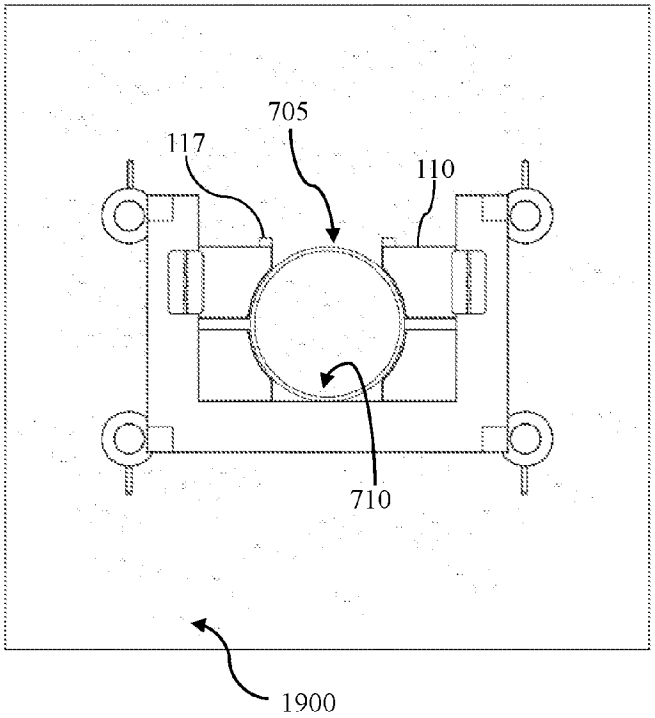
FIG. 22 is a top view of the positioning template located above an intended hole and column location with the tubular sleeve positioned above grade level and inside a first opening of the first frame, according to a non-limiting example embodiment.
Figure 21:
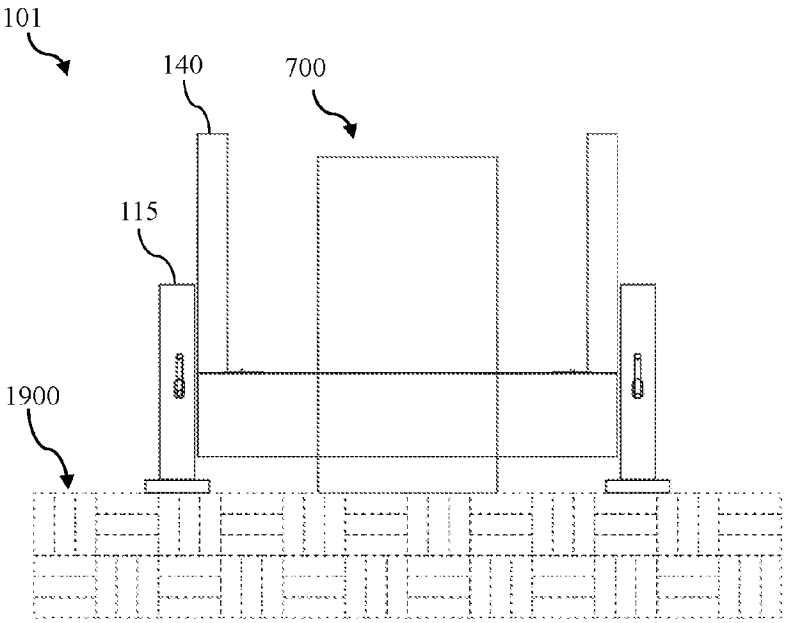
FIG. 21 is a rear partial cross-sectional view of the positioning template located above an intended hole and column location with the tubular sleeve positioned above grade level and inside a first opening of the first frame, according to a non-limiting example embodiment.

The next step in the process is to insert a tubular sleeve below grade level 1900 by passing the tubular sleeve through the first opening 125 of the U-shaped frame. FIGS. 21 and 22 illustrate the positioning template located above an intended hole and column location with the tubular sleeve positioned above grade level 1900 and inside a first opening of the first frame, according to a non-limiting example embodiment. In order to position the tubular sleeve 700 within the first opening, a user may apply forces to the handle 117 of the hinged panels of the positioning template in order to move the first end 111 of the panels away from the center point 126 (as illustrated in FIGS. 1 and 3) of first opening. In operation, once the panels are opened, then a user can more easily maneuver the tubular sleeve 700 into position. The panels 110 are hinged such that it allows a user to position the various components of the system into position without damaging a portion of the horizontally aligned panels.

Figure 24:
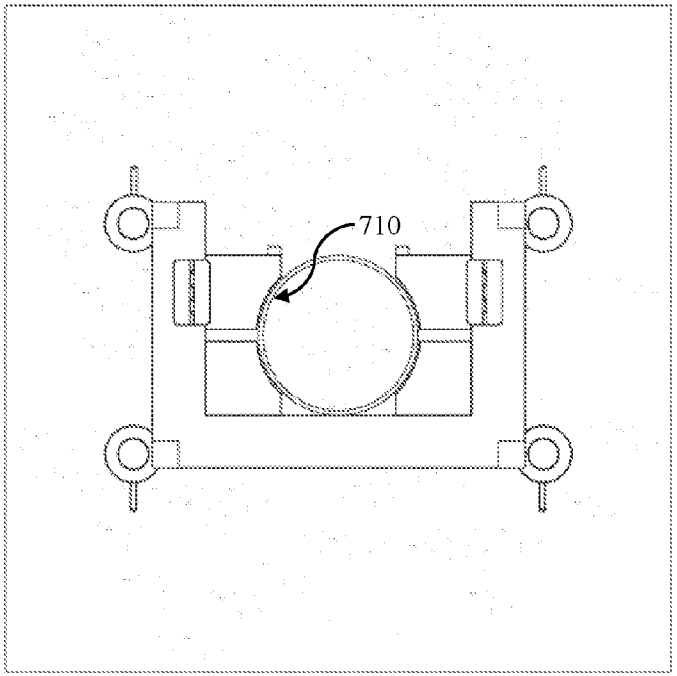
FIG. 24 is a top view of the positioning template located above a hole and intended column location with the tubular sleeve below grade level, according to a non-limiting example embodiment.
Figure 23:
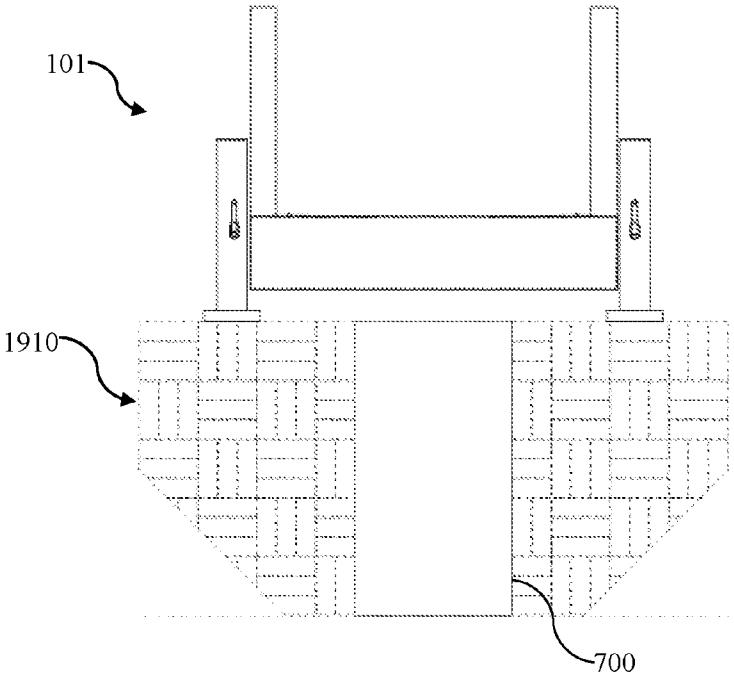
FIG. 23 is a rear partial cross-sectional view of the positioning template located above a hole and intended column location with the tubular sleeve below grade level, according to a non-limiting example embodiment.

The next step in the process is illustrated in FIGS. 23 and 24. FIGS. 23 and 24 are rear and top views, respectively, of the positioning template located above the hole that has been dug and intended column location with the tubular sleeve positioned below 1900 grade level and inside a first opening 125 of the first frame. In operation, a user may remove dirt and other material from the intended hole location 2005 before or during the tubular sleeve is being easily driven into the ground. As is illustrated in FIGS. 21 and 22, when in the closed position, the outward wall 705 of the tubular sleeve is held tightly in place by the horizontally aligned panels. The horizontally aligned panels act as a guiding mechanism for when the tubular sleeve is driven downward into the hole location. It is also worth noting that the panels have a height (as illustrated in FIG. 1 as H) that guides the tubular sleeve as it is driven downward. In operation, a pile driver or other mechanical device may be used in order to force the tubular sleeve downward into the ground. FIGS. 23 and 24 illustrate the tubular sleeve having been driven into the ground such that the first end or upward facing end of the tubular sleeve is proximate to grade level. Next, if any soil remains inside of the tubular sleeve, an operator may the remove the dirt and other materials from inside of the tubular sleeve. In other embodiments, material is completely removed from the intended hole location before the tubular sleeve is driven into the ground.

Figure 26:
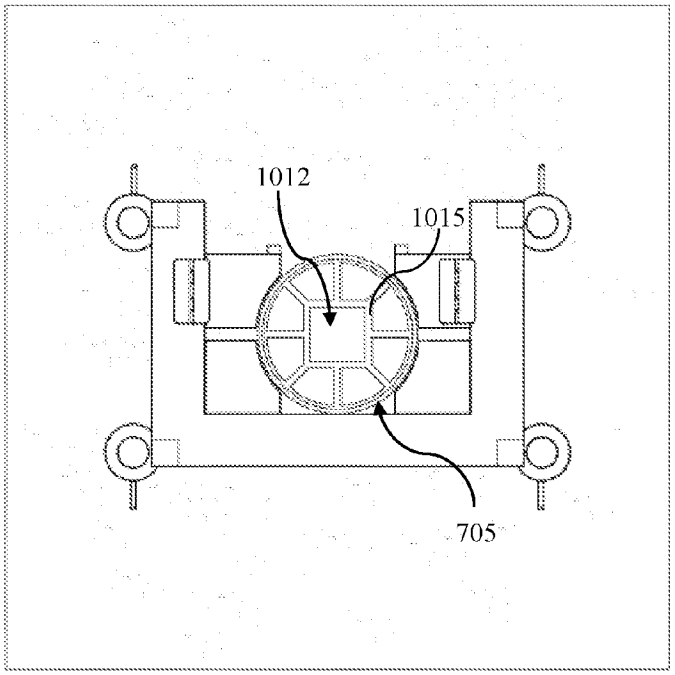
FIG. 26 is a top view of the positioning template located above a hole and intended column location with the second frame inserted into the tubular sleeve below grade level, according to a non-limiting example embodiment.
Figure 25:
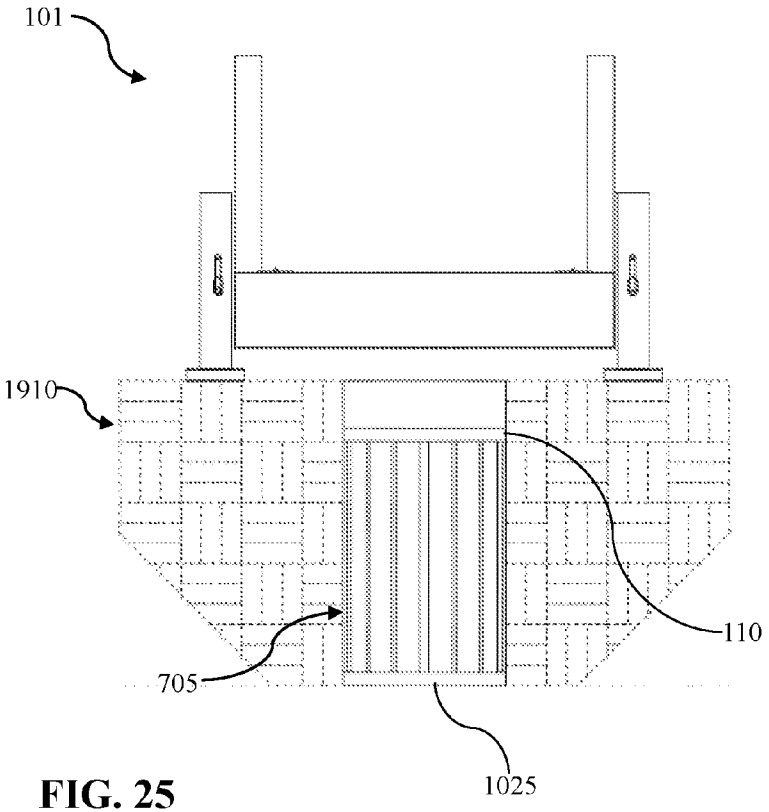
FIG. 25 is a rear partial cross-sectional view of the positioning template located above a hole and intended column location with the second frame inserted into the tubular sleeve below grade level, according to a non-limiting example embodiment.

The next step in the process is to insert the second frame 1000 into the tubular sleeve 700. However, it is understood that the step of inserting the second frame into the tubular sleeve may also be done before the second frame and tubular sleeve are installed into the ground. FIGS. 25 and 26 are rear and top views, respectively, of the positioning template located above the hole and intended column location with the second frame inserted into the tubular sleeve below grade level, according to a non-limiting example embodiment. As mentioned above, the second frame has a first end 1005 and an opposing second end 1010, wherein each end of the second frame defines a second opening 1012 defined by a at least one frame 1015. In the present embodiment, the second opening is square shaped surrounded by four frame members. The second frame also includes an elongated bar 1020 spanning between the first end and the second end of the second frame along each of the four frame member 1015. The second frame is configured to guide a pile when the pile is driven downward below grade level through the square shaped openings and between the elongated bars. As explained above, it is understood that, for example, if the second opening is another shape, such as circular, then the pile would be cylindrical, and the elongated bars may be positioned along the circumference of the second opening (which is circular) spanning from the first end of the second frame to the second end of the frame so that the second opening and the elongated bars may guide the pile as it is driven downward.

As illustrated in FIG. 10, the second frame may also include auxiliary frame members 1030 that are configured to attach the frame members 1015 to the circular shaped or ring-shaped frame member 1025 on each end of the second frame. As is illustrated in FIGS. 25 and 26, the minimal clearance between the inside cross-sectional diameter of the tubular sleeve and outside cross-sectional diameter of the second frame is minimal thereby reducing the amount of potential variation or inaccuracies when positioning pile. Additionally, in operation, the elongated bars 1020 and frame members 1015 are configured to constrain and maintain the pile when it is inserted into a driven downward into the ground so as to maintain the position of the pile and accurately position the pile.

Figure 28:
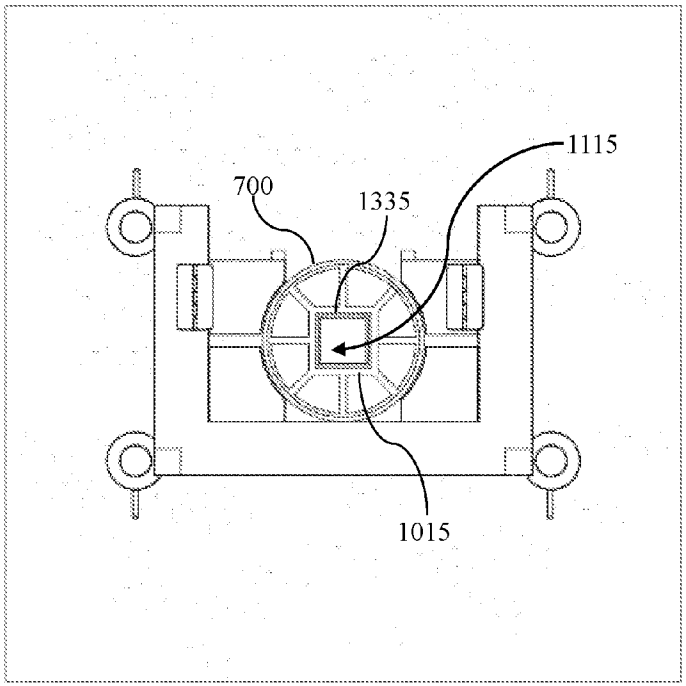
FIG. 28 is a top view of the positioning template located above a hole and intended column location with the second frame inserted into the tubular sleeve below grade level and having the pile partially inserted into the system, according to a non-limiting example embodiment.
Figure 27:
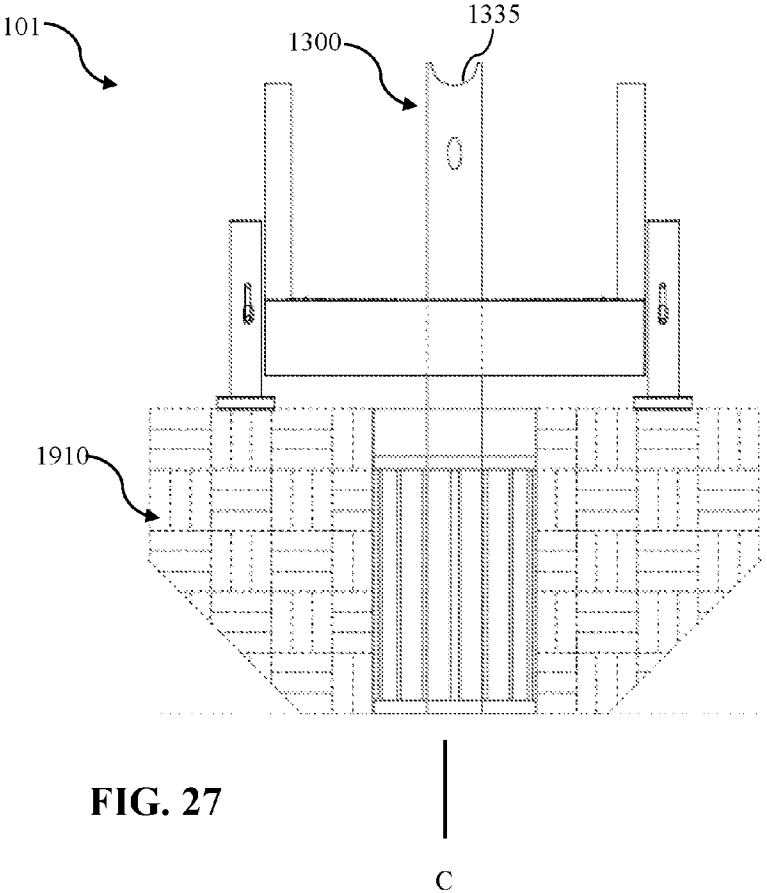
FIG. 27 is a rear partial cross-sectional view of the positioning template located above a hole and intended column location with the second frame inserted into the tubular sleeve below grade level and having the pile partially inserted into the system, according to a non-limiting example embodiment.

The next step is to insert a pile 1300 into the second opening 1115 or opening of the second frame 700. FIGS. 27 and 28 are rear and top views, respectively, of the positioning template 101 located above an intended column location with the second frame inserted into the tubular sleeve below grade level inside the hole and having the pile partially inserted into the system, according to a non-limiting example embodiment. The inside cross-sectional diameter of the second opening 1115 is slightly bigger than the outside cross-sectional diameter of the pile. In the present embodiment, the pile is square shaped such that it can be inserted into the second openings of the second frame. Because the small amount of space between the inside cross-sectional diameter of the square shaped opening and the outside cross-sectional diameter of the pile, when driving the pile downward, the pile is only able to deviate minimally from the vertical line represented by line C in FIG. 27. As a result, the pile is able to be positioned accurately below the intended column location. As mentioned above, the elongated bars 1020 along with the frame elements 1015 that surrounds the second opening are able to maintain the pile in a vertical position and from deviating off the intended hole location.

Figure 30:
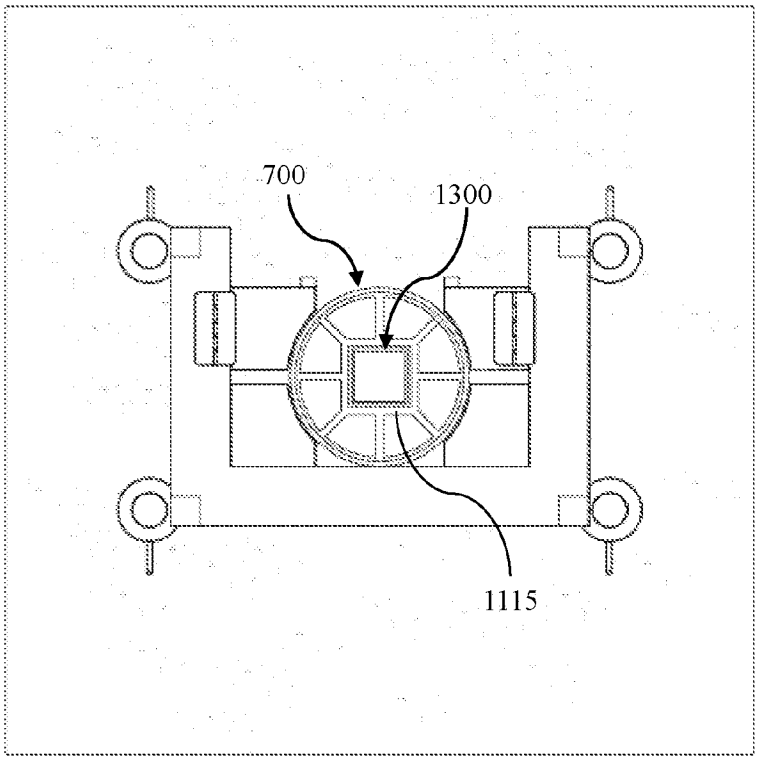
FIG. 30 is a top view of the positioning template located above a hole and intended column location with the second frame inserted into the tubular sleeve below grade level and having the pile driven into the ground, according to a non-limiting example embodiment.
Figure 29:
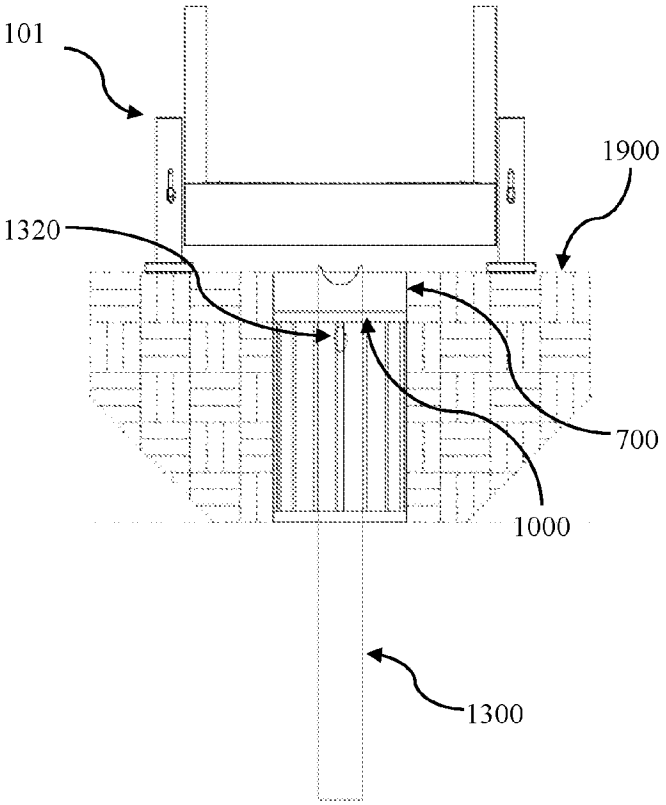
FIG. 29 is a rear partial cross-sectional view of the positioning template located above a hole and intended column location with the second frame inserted into the tubular sleeve below grade level and having the pile driven into the ground, according to a non-limiting example embodiment.

The next step is to drive the pile downward until a first end 1305 of the pile is proximate to grade level 1900 and illustrated in FIGS. 29 and 30. FIGS. 29 and 30 are rear and top views, respectively, of the positioning template located above a hole and intended column location with the second frame 1000 inserted into the tubular sleeve below grade level and inside a whole and having the pile driven into the ground, according to a non-limiting example embodiment. As explained above, the frame members 1015 and elongated bars 1020 guide the pile as it is driven downward into the ground.

Figure 32:
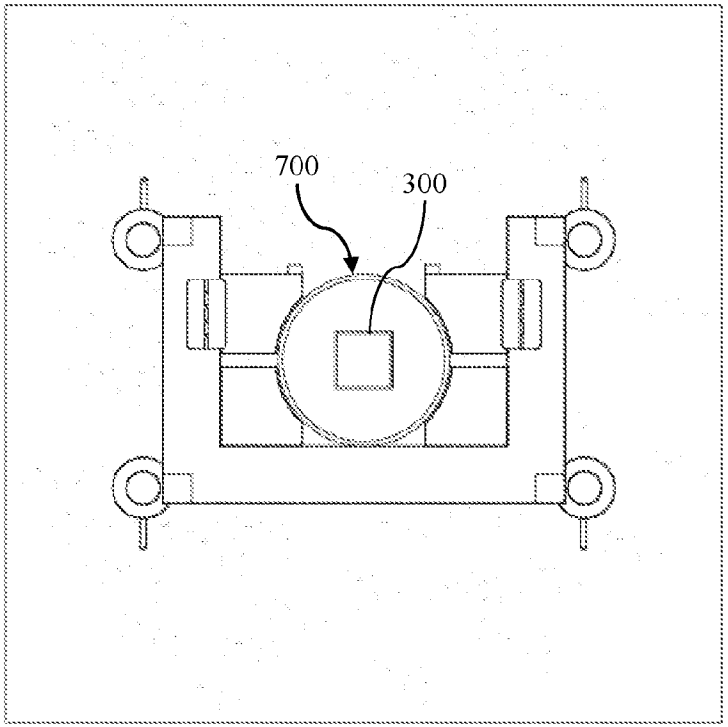
FIG. 32 is a top view of the positioning template located above a hole and intended column location with the second frame removed from the tubular sleeve and having the pile partially driven into the ground, according to a non-limiting example embodiment, according to an example embodiment.
Figure 31:
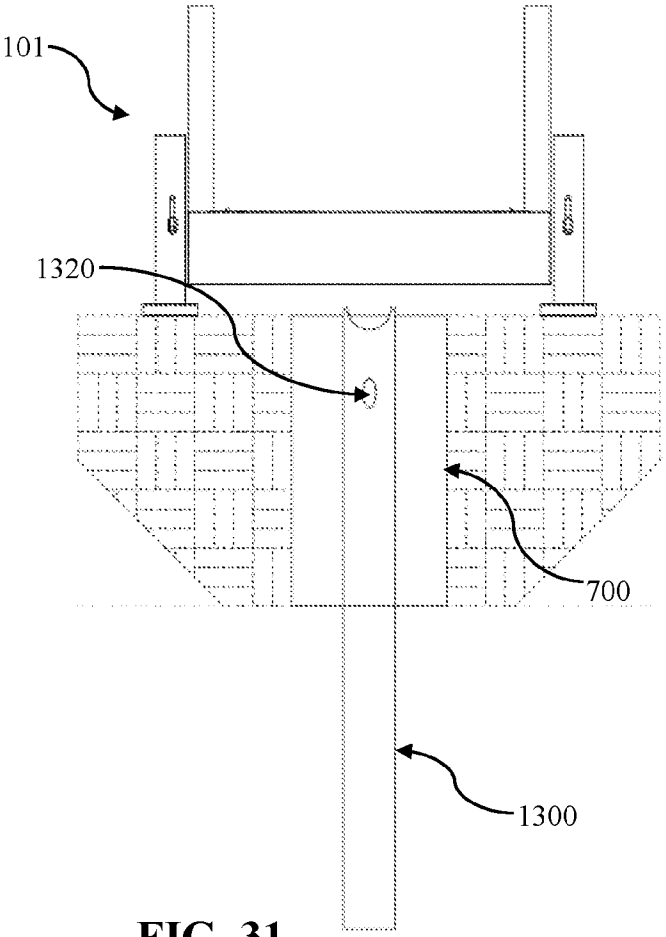
FIG. 31 is a rear partial cross-sectional view of the positioning template located above a hole and intended column location with the second frame removed from the tubular sleeve and having the pile partially driven into the ground, according to a non-limiting example embodiment.

Next, the second frame may be removed as is illustrated in FIGS. 31 and 32. FIGS. 31 and 32 are rear and top views of the positioning template located above a hole and intended column location with the second frame removed 1000 from the tubular sleeve 700 and having the pile driven into the ground. With the second frame removed, the first pile opening 1320 or second pile opening 1325 is visible below grade 1900. At this point, any dirt or material that may have fallen inside the space between the pile and the inside wall of the sleeve may be removed if necessary. Additionally, with the second frame 1000 removed, FIG. 32 illustrates that the pile is inside the tubular sleeve below grade.

Figure 34:
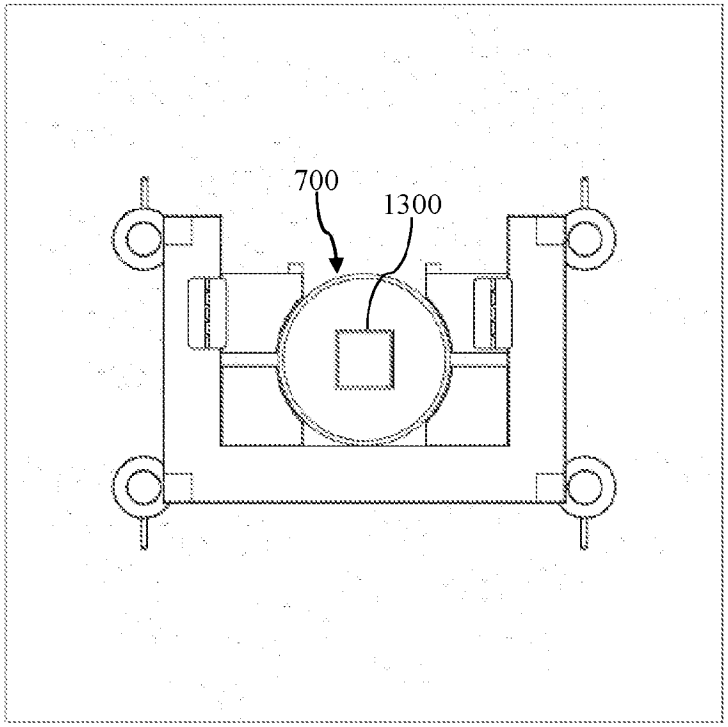
FIG. 34 is a top view of the positioning template located above a hole and intended column location with the second frame removed from the tubular sleeve and having the pile driven into the ground to a desired depth, according to a non-limiting example embodiment.
Figure 33:
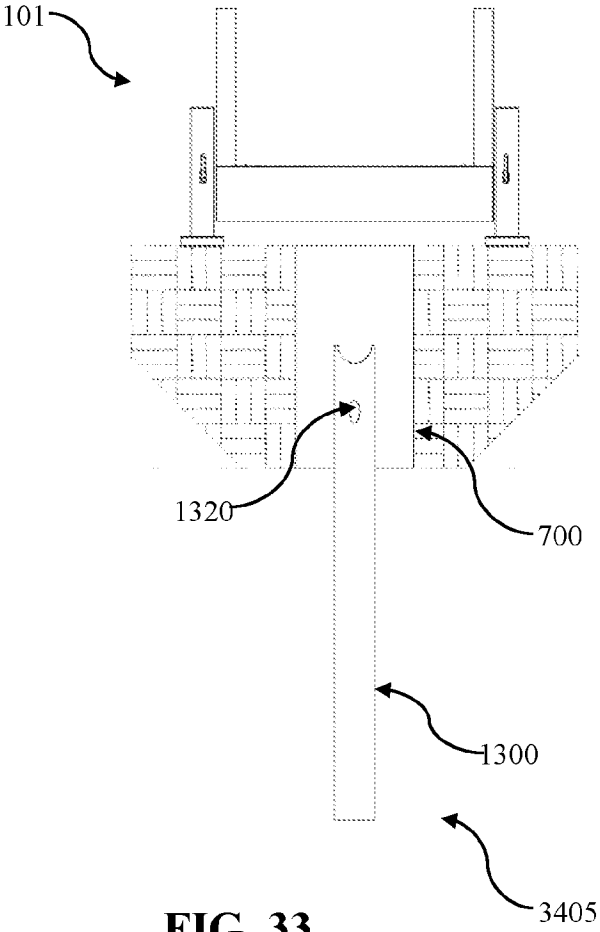
FIG. 33 is a rear partial cross-sectional view of the positioning template located above a hole and intended column location with the second frame removed from the tubular sleeve and having the pile driven into the ground to a desired depth, according to a non-limiting example embodiment.

Next, the pile is driven downward until a second end of the pile reaches a desired depth. FIGS. 33 and 34 are a rear partial cross-sectional and top views, respectively, of the positioning template located above a hole and column location with the second frame removed from the tubular sleeve and having the pile driven into the ground to a desired depth 3405. At this point, the second frame is not needed because the pile is sufficiently driven into the ground such that it will not inadvertently move into an undesirable position without an extremely large amount of force. Also worth noting is that the hinged panels 115 may also be moved into the open configuration to more easily access the pile in order to drive and downwards. As illustrated in FIG. 33, the first end of the pile is positioned such that the first pile opening 1320 is proximate to the second end or lower end of the tubular sleeve. The desired depth may be determined based upon the size of the column that is to be installed. For example, for larger columns and walls, a deeper desired depth may be used. On the other hand, for shorter columns or walls, a shallower desired depth may be selected.

Figure 36:
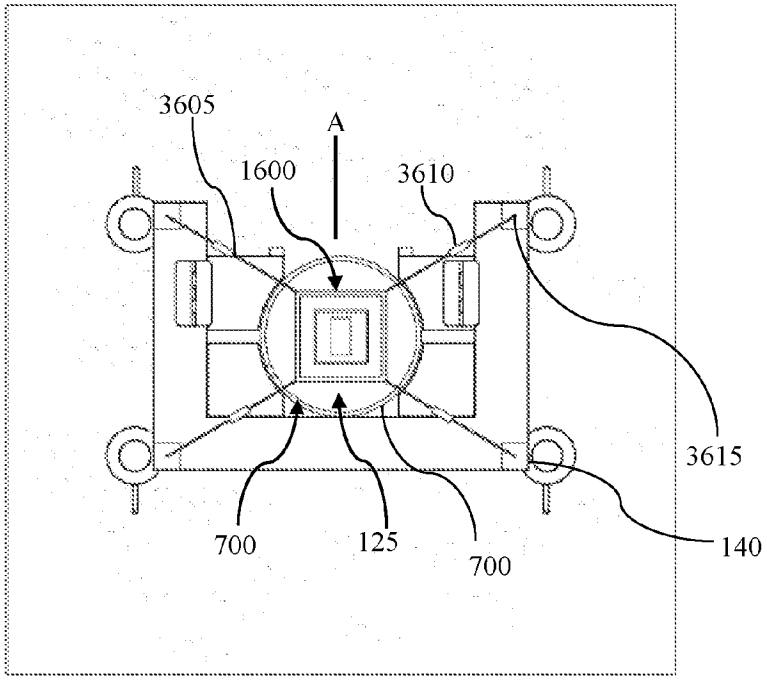
FIG. 36 is a top view of the positioning template with the second frame removed from the tubular sleeve, having the pile fully driven to a desired depth, wherein a column is on top of the pile, according to a non-limiting example embodiment.
Figure 35:
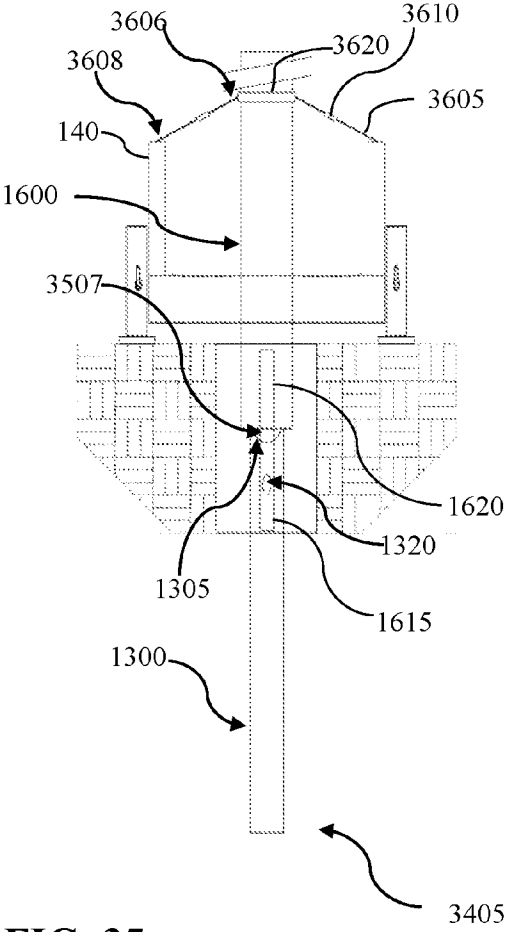
FIG. 35 is a rear partial cross-sectional view of the positioning template with the second frame removed from the tubular sleeve, having the pile fully driven to a desired depth, wherein a column is on top of the pile, according to a non-limiting example embodiment.

The next step would be to position a connecting tube 1615 of the column 1600 into the first end 3005 of the pile. FIGS. 35 and 36 are rear partial cross sectional and top views, respectively, of the positioning template with the second frame removed from the tubular sleeve, having the pile 1300 fully driven to a desired depth 3405. In FIGS. 35 and 36 a column is positioned on top of the pile such that the connecting 1615 tube is inside a first end of the pile. When the lower or second end of the column is on top of the pile, an opening 3507 is formed between the concave shaped first end 1305 and the lower end of the column. As mentioned above, this opening 3507 may act as an air vent for when concrete in a flowable state or for is pumped into the openings 1620, 6025 in order to form the connection between the pile and the column 1600. Additionally, in order to stabilize and maintain the column on top of the pile, before, during and after the concrete in a flowable state is poured and before the concrete is cured, anchoring lines 3605 may be used to anchor and secure the column in position. The anchoring line may be a cable, wire, rope, nylon, mesh, etc. or any other device that is capable of transferring loads.

In the present embodiment, as mentioned above, the positioning template may further include posts 140 proximate to the perimeter of the first frame 101. The post may be vertically aligned shaped posts that extends upwards above the jacking mechanisms 115. Each post comprises load bearing properties and comprise material such as concrete, wood, metal, iron, wrought iron, cast iron, steel, stainless steel, composites, alloys, bamboo, reinforce plastic or other materials capable for resisting loads. In the present embodiment, each post is a rectangular shaped body, however it is understood that other shapes may also be used and are within the scope and spirit of the present invention.

In operation, a first end 3606 of each anchoring line 3610 may be coupled to the column 1600. In the present embodiment, a column clamp 3620 is used. However, other means of fastening the first of each anchoring line 3610 to the column may also be used and is within the spirit and scope of the present invention. In the present embodiment, the column clamp allows and anchoring line to be attached to each corner of the square shaped column as illustrated in FIG. 36. In the present embodiments, the second end 3608 of the anchoring line may be attached or fastened to the first or top end of the post. However, it is understood that the anchoring line may be attached to other positions along each post. In one embodiment, the fastener for attaching the second end of the line to the post may include a bolt, a ring, screw, clamp, rope, cable, u-bolt, eye-lag, eye bolt, j-bolt, etc.

In the present embodiment, a tensioning device 3610 is coupled to each anchoring line between the end of the line in order to adjust the tension of each line to adequately secure and stabilize the column until the concrete in a flowable state has hardened or cured. In the present embodiment, the tensioning device is a turnbuckle. A turnbuckle may be a coupling with female screw threads used to connect two threaded rods, lengthwise and to regulate their length or tension. However, other tensioning devices may also be used and are within the scope and spirit of the present invention. The tensioning device is simply a device that is able to adjust the tension by adjusting the length of the line so that the tension can increase or decrease as necessary. In operation, after a crane or other moving device has positioned the column into place, the tensioning device 3610 on each of the lines will adjusted so that the column is level along the x-y axis.

In one embodiment, a reinforcing matrix three 710 then next be installed after the column has been positioned on top of the pile. In other embodiments, the reinforcing matrix maybe installed prior to positioning or maneuvering the column 6000 on top of the pile 1300. The reinforcing matrix may comprise rebar that surrounds the connection formed between the lower or second end of the column and the upper or first end of the pile 1300. In one embodiment, the rebar cage may comprise a plurality of horizontal rings or loops 3715 of rebar and a plurality of vertical sections of rebar 3720 that are connected or coupled to the horizontal rings or loops. The loops or rings to be coupled by welding, wire material, fasteners, soldering, etc. In one embodiment, the horizontal rings 3715 that surrounds the connection point may include #4 rebar separated 6" apart surrounding the connection point. In one embodiment, the vertical bars 3720 may include 8 #5 bars with hooks at each end that attach to the horizontal rings. However, other embodiments of the reinforcing matrix may also be used and are within the spirit and scope of the present invention. In other embodiments the reinforcing matrix may not be used. In other embodiments, other means of providing a stronger connection point in addition to the connection tube 1620 may also be used.

Figure 38:
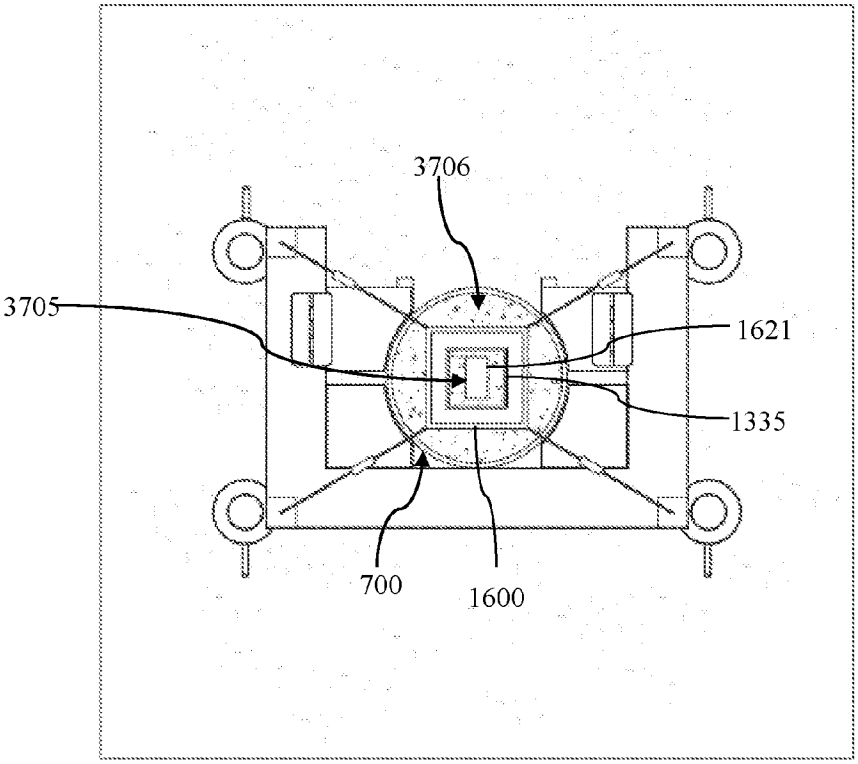
FIG. 38 is a top view of the positioning template with the second frame removed from the tubular sleeve, wherein the pile is fully driven into the ground, wherein a column on top of the pile, and wherein a reinforcing matrix and concrete surrounds the connected ends of the pile and column, according to a non-limiting example embodiment.
Figure 37:
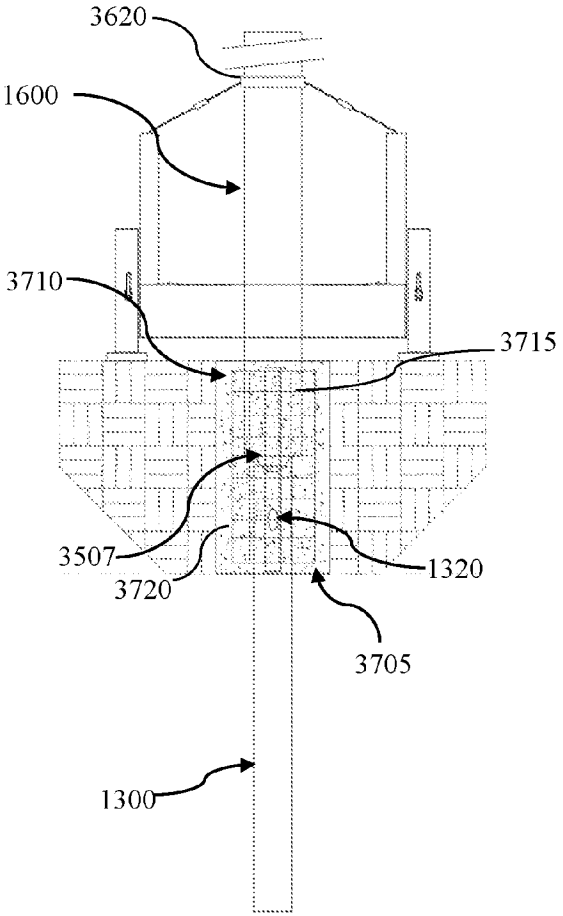
FIG. 37 is a rear partial cross-sectional view of the positioning template with the second frame removed from the tubular sleeve, wherein the pile driven to the desired depth, wherein a column on top of the pile, and wherein a reinforcing matrix and concrete surrounds the connected ends of the pile and column, according to a non-limiting example embodiment.

The next step in the process includes filling the pile and hole with concrete in a flowable state. FIGS. 37 and 38 are rear partial cross-sectional and top views, respectively, of the positioning template 101 with the second frame 1000 removed from the tubular sleeve 700, wherein the pile is fully driven to the desired depth, a column is on top of the pile and connected to the pile, and reinforcing matrix 3710 and concrete 3705 surrounds the connected ends of the pile and column, according to a non-limiting example embodiment. Additionally, FIGS. 37 and 38 illustrate concrete in the annular space inside of the pile 1600. In one embodiment reinforcing matrix comprises steel or other reinforcing material.

Next, in one embodiment of the process, after the connecting tube of the column has been positioned into the first end of the pile, and the anchoring lines have been anchored to the post 140 of the positioning template, but before the pile has been filled with concrete in a flowable state, the tubular sleeve may be removed the tubular sleeve may be removed to above the panels (not shown). In another embodiment, the tubular sleeve can be removed after the concrete in a flowable state has filled the system. An operator may analyze the soil conditions of a hole location to determine whether to remove the tubular sleeve before or after concrete in a flowable state has filled the system. In operation, a user may use a 2×4, a metal rod, bar, etc. in order to maintain the tubular sleeve above the panels so that the tubular sleeve may be removed. It is also worth noting that the design of the system should be such that the dimensions of the system is such that the tubular sleeve can be obtained above the panels without interfering with the anchoring lines connected to the posts 140.

Figure 40:
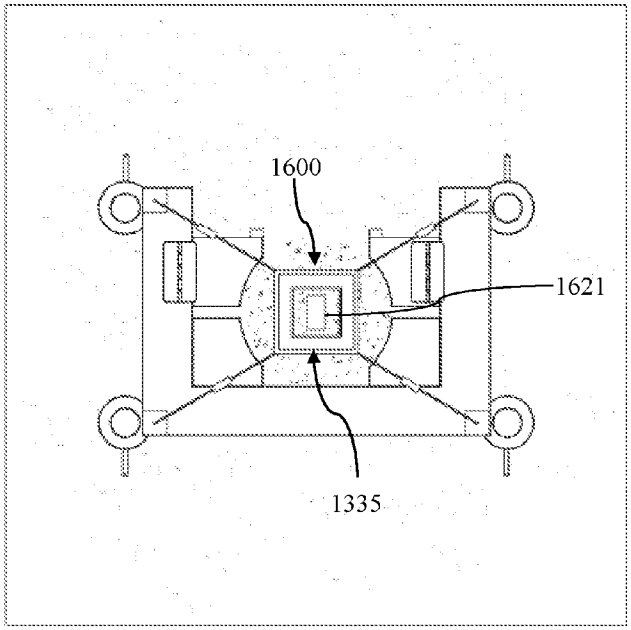
Figure 39:
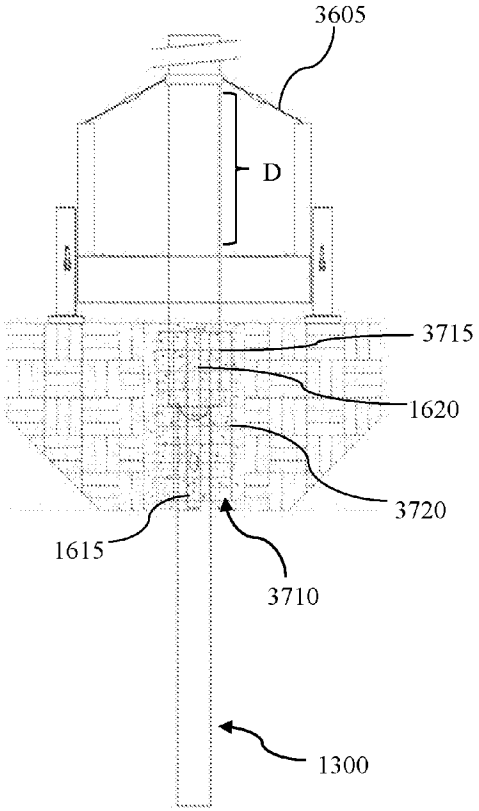
FIG. 39 is a rear partial cross-sectional view of the positioning template with the second frame and tubular sleeve removed from the system, wherein the pile is fully driven into the ground, wherein a column is on top of the pile, and wherein a reinforcing matrix and concrete surrounds the connected ends of the pile and column, according to a non-limiting example embodiment; and, FIG. 40 is a top view of the positioning template with the second frame and tubular sleeve removed from the system, wherein the pile is fully driven into the ground, wherein a column is on top of the pile, and wherein a reinforcing matrix and concrete surrounds the connected ends of the pile and column, according to a non-limiting example embodiment; and, FIG. 41 is a top view of a series of columns installed in line with a series of panels forming a wall, according to a non-limiting example embodiment.

FIGS. 39 and 40 are rear partial cross-sectional view and top views of the positioning template with the second frame and tubular sleeve 700 removed from the system, wherein the pile is fully driven into the ground, the column is on top of the pile, the rebar cage and concrete surrounds the connected ends of the pile and column. While the tubular sleeve is not shown above the panels, it is understood that the sleeve can remain within the area the without interfering with the anchoring lines 3605.

In operation, after the column has been positioned on top of pile, a user may pump or pore concrete in a flowable state into one of the pile openings 1320, 1325. As mentioned above, it is ideal but not mandatory that the tubular sleeve may be removed from the hole before pouring the concrete in a flowable state. As concrete in a flowable state is pumped or poured into either of pile openings 1320, 1325, the concrete fills inside the annular space inside of the pile. The opening 3507 formed by the concave end of the pile forms an air vent providing easier means for the concrete to be pumped to the desired height. In operation, if the concrete in a flowable state is pumped into one pile opening, then the second pile opening may also act as a vent and also as a viewing hole to determine the amount of concrete in a flowable state inside of the pile. In one embodiment, after the pile is the completely filled concrete in a flowable state, then a user may additionally pour concrete in a flowable state into the space between the connected pile/column and the tubular sleeve 700. Next, a user may wait a certain period of time in order for the concrete in a flowable state secure. Additionally, after the concrete in a flowable state has cured or hardened, then the anchoring lines may be removed, the hinge panels may be moved to an open state such that the template can easily be removed leaving the connected column and pile.

FIG. 41 is a top view of a series of columns connected with piles installed in line with a series of panels forming a wall, according to a non-limiting example embodiment. FIG. 41 illustrates that each column 1600 is positioned in between two panels 410 forming a wall. In the present embodiment, FIG. 41 illustrate the rectangular shaped parameter 1621 of the connecting tube that has a longitudinal axis represented by line A that is perpendicular with the longitudinal axis of the wall represented by line B. As a result of having longitudinal axis A and longitudinal axis B perpendicular to each other, the connecting tube provides a greater amount of wind load protection from forces acting upon the wall substantially perpendicular to longitudinal axis B. As previously explained, the system allows a user to accurately position columns in areas that may have a high water table as well as a relatively low overhead clearance.

Although the subject matter has been described in language specific to structural features and/or methodological acts, it is to be understood that the subject matter defined in the appended claims is not necessarily limited to the specific features or acts described above. It is also understood that while steps were performed in certain orders, very steps may be substituted, removed, or repositioned that are within the spirit and scope of the present invention. Rather, the specific features and acts described above are disclosed as example forms of implementing the claims.

We claim:

1. A system for positioning and anchoring columns comprising:

(a) a positioning template comprising:

a first frame configured to support a plurality of horizontally aligned panels;

a plurality of jacking mechanisms, wherein the jacking mechanisms are configured for leveling the horizontally aligned panels;

a first opening defined by the horizontally aligned panels, wherein the panels are configured to guide a tubular sleeve when the tubular sleeve is driven downward below grade level through the first opening;

(b) the tubular sleeve is configured for passing through the first opening of the first frame and for receiving a second frame inside the tubular sleeve;

(c) the second frame comprising:

a first end and an opposing second end, wherein each end of the second frame includes at least one frame member that defines a second opening;

a plurality of elongated bars spanning between the first end and the second end, wherein the elongated bars and frame members are configured to guide a pile when the pile is driven downward below grade level;

(d) the pile having a first end and an opposing second end; and, (e) a column, wherein the column has a first end and an opposing second end, wherein a connecting tube extends out from the second end.

2. The system of claim 1, wherein the system comprises four panels, wherein two of the panels are pivotally connected to the first frame so that a first end of the pivotally connected panels can pivot away from a center point of the first opening.

3. The system of claim 1, wherein the pile comprises a concave first end.

4. The system of claim 1, wherein the connecting tube comprises a rectangular shaped perimeter, and wherein the connecting tube is aligned such that a longitudinal axis of the connecting tube is perpendicular to a longitudinal axis of an anticipated wall.

5. The system of claim 1, wherein the positioning template further includes a plurality of posts, wherein each post is configured for anchoring a line coupled to the column when said column is positioned inside first opening.

6. The system of claim 5, wherein a first end of each line couples to a clamp attached to the column and a second end of each line is attached to one of the posts, and wherein a tensioning device is coupled to each line and configured to adjust the tension of each line.

7. The system of claim 1, wherein the pile comprises a first pile opening and a second pile opening proximate to the first end of the pile.

8. The system of claim 1, wherein the second frame further comprises a plurality of vertical supporting members spanning between the first end and second end of the second frame.

9. The system of claim 1, wherein the system further comprises a reinforcing matrix configured to surround the pile and the column, the reinforcing matrix comprising a plurality of vertically aligned rods coupled to a plurality of horizontally aligned loops.

10. The system of claim 9, wherein the second frame is configured to be removed from the system after inserting the pile into the second opening and forcing the pile downward until a first end of the pile is proximate to grade level.

11. The system of claim 1, wherein the tubular sleeve is configured to be removed from below grade level after the column is vertically situated on top of the pile.

12. A system for positioning and anchoring columns comprising:

(a) a positioning template comprising:

a u-shaped frame configured to support at least two horizontally hinged aligned panels;

a plurality of jacking mechanisms, wherein the jacking mechanisms are configured for leveling the horizontally aligned panels;

a plurality of posts, wherein each post is configured for anchoring a line coupled to the column when said column is positioned inside first opening;

a first opening defined by the horizontally aligned panels, wherein the u-shaped frame is configured to guide a tubular sleeve when the tubular sleeve is driven downward below grade level through the first opening;

(b) the tubular sleeve, wherein the tubular sleeve is configured for passing through the first opening of the first frame and for receiving a second frame inside the tubular sleeve;

(c) the second frame comprising:

a first end and an opposing second end, wherein each end of the second frame includes four frame members that define a square shaped opening;

an elongated bar spanning between the first end and the second end along each frame member, wherein the second frame is configured to guide a pile when the pile is driven downward below grade level;

(d) the pile having a first end and an opposing second end, wherein a first end of the pile is configured for receiving a connecting tube of a column; and, (e) a column, wherein the column has a first end and an opposing second end, wherein a connecting tube extends out from the second end.

13. The system of claim 12, wherein the pile comprises a concave first end.

14. The system of claim 13, wherein the connecting tube comprises a rectangular shaped perimeter, and wherein the connecting tube is aligned such that a longitudinal axis of the connecting tube is perpendicular a longitudinal axis of an anticipated wall.

15. The system of claim 13, wherein a first end of each line is couple to a clamp attached to the column and a second end of each line is attached to one of the posts, and wherein a tensioning device is coupled to each line and configured to adjust the tension of each line.

16. The system of claim 13, wherein the system comprises four panels, wherein two of the panels are pivotally connected to the first frame so that a first end of the pivotally connected panels can pivot away from a center point of the first opening.

17. A method for positioning and anchoring columns comprising:

(a) positioning a template above an intended hole location, wherein the template comprises:

a first frame configured to support a plurality of horizontally aligned panels;

a plurality of jacking mechanisms, wherein the jacking mechanisms are configured for leveling the horizontally aligned panels;

a first opening defined by the horizontally aligned panels, wherein the panels are configured to guide a tubular sleeve when the tubular sleeve is driven downward below grade level through the first opening;

(b) leveling the horizontally aligned panels using the jacking mechanisms;

(c) removing material from the intended hole location to form a hole;

(d) guiding a tubular sleeve below grade level into the hole by passing the tubular sleeve through the first opening;

(e) inserting a second frame into the tubular sleeve, wherein the second frame comprises:

a first end and an opposing second end, wherein each end of the second frame includes a plurality of frame members that define a second opening;

a plurality of elongated bars between the first end and the second end, wherein the elongated bars and frame members are configured to guide a pile when the pile is driven downward below grade level;

(f) inserting the pile into the square shaped opening and forcing the pile downward until a first end of the pile is proximate to grade level;

(g) removing the second frame;

(h) driving the pile down until a second end of the pile reaches a desired depth;

(i) positioning a connecting tube of a column into the first end of the pile; and, (j) filing the pile and hole with concrete in a flowable state.

18. The method of claim 17, wherein the method further includes, between steps (h) and (i), installing a reinforcing matrix around the pile, the reinforcing matrix comprising a plurality of vertically aligned rods coupled to a plurality of horizontally aligned loops.

19. The method of claim 18, wherein the method further includes, between steps (i) and (j), moving the tubular sleeve to above the panels.

* * * * *